US008346547B1

(12) United States Patent
Tang

(10) Patent No.: US 8,346,547 B1
(45) Date of Patent: Jan. 1, 2013

(54) ENCODER QUANTIZATION ARCHITECTURE FOR ADVANCED AUDIO CODING

(75) Inventor: Lijie Tang, Shanghai (CN)

(73) Assignee: Marvell International Ltd., Hamilton (BM)

( * ) Notice: Subject to any disclaimer, the term of this patent is extended or adjusted under 35 U.S.C. 154(b) by 271 days.

(21) Appl. No.: 12/780,634

(22) Filed: May 14, 2010

Related U.S. Application Data

(63) Continuation-in-part of application No. 12/626,161, filed on Nov. 25, 2009.

(60) Provisional application No. 61/179,149, filed on May 18, 2009.

(51) Int. Cl.
*G10L 21/00* (2006.01)
*G10L 19/14* (2006.01)
*G10L 19/00* (2006.01)

(52) U.S. Cl. ..... 704/230; 704/201; 704/205

(58) Field of Classification Search ..... 704/200, 704/200.1, 201, 203, 204, 205, 225, 229, 704/230, 500, 501, E19.01, 15–19, 4
See application file for complete search history.

(56) References Cited

U.S. PATENT DOCUMENTS

| | | | | |
|---|---|---|---|---|
| 6,499,010 | B1 * | 12/2002 | Faller | 704/229 |
| 7,003,449 | B1 * | 2/2006 | Absar et al. | 704/200.1 |
| 7,539,612 | B2 * | 5/2009 | Thumpudi et al. | 704/200.1 |
| 8,010,370 | B2 * | 8/2011 | Baumgarte | 704/500 |
| 2003/0115041 | A1 * | 6/2003 | Chen et al. | 704/200.1 |
| 2003/0212551 | A1 * | 11/2003 | Rose et al. | 704/230 |
| 2008/0027709 | A1 * | 1/2008 | Baumgarte | 704/200.1 |

* cited by examiner

*Primary Examiner* — Jesse Pullias

(57) ABSTRACT

An advanced audio coding (AAC) encoder quantization architecture is described. The architecture includes an efficient, low computation complexity approach for estimating scalefactors in which a base scalefactor estimate is adjusted by a delta scalefactor estimate that is based, in part, on global scalefactor adjustments applied to the previously quantized/encoded frame. Using such feedback, the AAC encoder quantization architecture is able to produce scalefactor estimates that are very close to the actual scalefactor applied by the subsequent quantization and encoding process. The architecture further includes a frequency hole avoidance approach that reduces a magnitude of an estimated scalefactor to avoid generating frequency holes in quantized SFBs. The efficient, low computation complexity scalefactor estimation approach combined with the frequency hole avoidance approach allows the described AAC encoder quantization architecture to achieve high audio fidelity, with reduced noise levels, while reducing processing cycles and power consumption by approximately 40%.

22 Claims, 18 Drawing Sheets

ENCODER QUANTIZATION ARCHITECTURE FOR ADVANCED AUDIO CODING

INCORPORATION BY REFERENCE

This application is a continuation-in-part application of U.S. Non-provisional application Ser. No. 12/626,161, "EFFICIENT SCALEFACTOR ESTIMATION IN ADVANCED AUDIO CODING AND MP3 ENCODER," filed on Nov. 25, 2009, which is incorporated herein by reference in its entirety. Further, this application claims the benefit of U.S. Provisional Application No. 61/179,149, "A NEW AND HIGH PERFORMANCE AAC LC ENCODER QUANTIZATION ARCHITECTURE," filed on May 18, 2009, which is incorporated herein by reference in its entirety.

BACKGROUND

Adaptive quantization is used by frequency-domain audio encoders, such as the advance audio coding (AAC), to reduce the number of bits required to store encoded audio data, while maintaining a desired audio quality.

Adaptive quantization transforms time-domain digital audio signals into frequency-domain signals and groups the respective frequency-domain spectrum data into frequency bands, or scalefactor bands (SFBs). In this manner, the techniques used to eliminate redundant data, i.e., inaudible data, and the techniques used to efficiently quantize and encode the remaining data, can be tailored based on the frequency and/or other characteristics associated with the respective SFBs, such as the perception of the frequencies in the respective SFBs by the human ear.

For example, in advance audio coding, the interval, or scalefactor, used to quantize each respective scalefactor band (SFB) can be individually determined for each SFB. Selection of a scalefactor for each SFB allows the advance audio coding process to use scalefactors to quantize the signal in certain spectral regions (the SFBs) to leverage the compression ratio and the signal-to-noise ratio in those bands. Thus scalefactors implicitly modify the bit-allocation over frequency since higher spectral values usually need more bits to be encoded. The use of larger scalefactors reduces the number of bits required to encode a SFB, however, the use of larger scalefactors introduces an increase amount of distortion to the encoded signal. The use of smaller scalefactors decreases the amount of distortion introduced to the final encoded signal, however, the use of smaller scalefactors also increases the number of bits required to encode a SFB.

In order to achieve improved sound quality as well as improved compression, selection of an appropriate scalefactor for each SFB is an important process. Unfortunately, current encoder quantization architectures use approaches for selecting a scalefactor for a SFB that are computationally complex and processor cycle intensive. The performance of such architectures is not good enough to run on mobile devices.

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

SUMMARY

An advanced audio coding (AAC) encoder quantization architecture is described. The architecture includes an efficient, low computation complexity approach for estimating scalefactors in which a base scalefactor estimate is adjusted by a delta scalefactor estimate that is based, in part, on global scalefactor adjustments applied to the previously quantized/encoded frame. Using such feedback, the AAC encoder quantization architecture is able to produce scalefactor estimates that are very close to the actual scalefactor applied by the subsequent quantization and encoding process. The architecture further includes a frequency hole avoidance approach that reduces a magnitude of an estimated scalefactor to avoid generating frequency holes in quantized SFBs. The efficient, low computation complexity scalefactor estimation approach combined with the frequency hole avoidance approach allows the described AAC encoder quantization architecture to achieve high audio fidelity, with reduced noise levels, while reducing processing cycles and power consumption by approximately 40%.

In one embodiment, an audio encoder is described that includes a base scalefactor estimation module, that includes, a spectrum base scalefactor generating module that determines a base scalefactor for a SFB based on a spectrum value scalefactor generated for a spectrum value selected from the SFB, and a band scalefactor estimation module, that includes, a delta scalefactor estimation module that determines a delta scalefactor based on a noise level and the base scalefactor, and a band scalefactor module that determines a band scalefactor for the SFB based on the determined base scalefactor and the determined delta scalefactor.

In a second embodiment, a method of generating a scalefactor for a SFB is described that includes, determining a base scalefactor for a SFB based on a spectrum value scalefactor generated for a spectrum value selected from the SFB, determining a delta scalefactor based on a noise level and the base scalefactor, and determining a band scalefactor for the SFB based on the determined base scalefactor and the determined delta scalefactor.

In a third embodiment, an audio encoder is described that performs a method of generating a scalefactor for a SFB that includes, determining a base scalefactor for a SFB based on a spectrum value scalefactor generated for a spectrum value selected from the SFB, determining a delta scalefactor based on a noise level and the base scalefactor, and determining a band scalefactor for the SFB based on the determined base scalefactor and the determined delta scalefactor.

BRIEF DESCRIPTION OF THE DRAWINGS

Embodiments of an advanced audio coding (AAC) encoder quantization architecture will be described with reference to the following drawings, wherein like numerals designate like elements, and wherein.

DETAILED DESCRIPTION OF EMBODIMENTS

Figure 1:
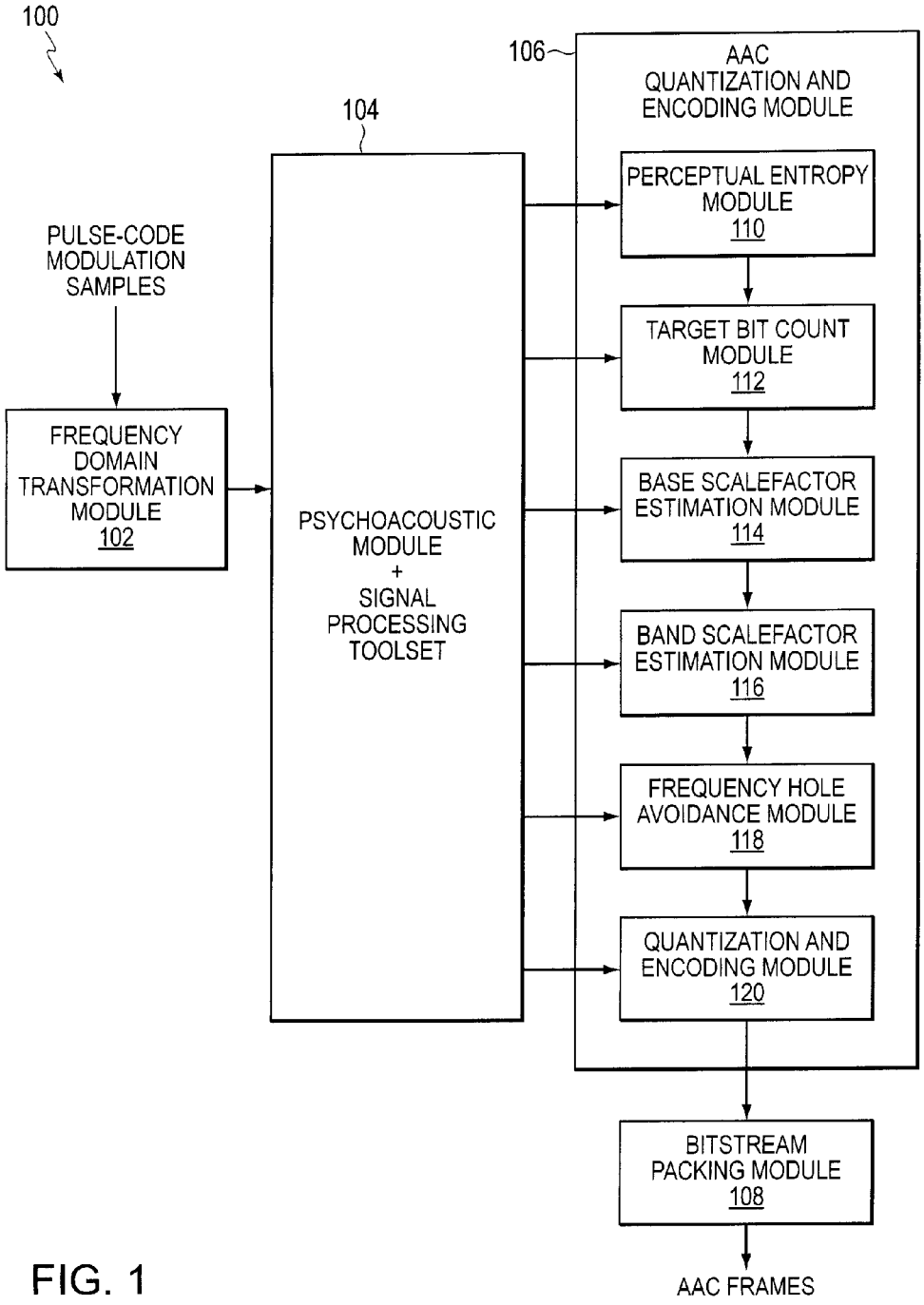
FIG. 1 is a block diagram of an embodiment of the described AAC encoder quantization architecture.

FIG. 1 is a block diagram of an embodiment of the described AAC encoder quantization architecture. As shown in FIG. 1, AAC encoder quantization architecture 100 can include a frequency domain transformation module 102, a psychoacoustic module with signal processing toolset 104, an AAC quantization and encoding module 106, and a bitstream packing module 108. As further shown in FIG. 1, AAC quantization and encoding module 106 can include a perceptual entropy module 110, a target bit count module 112, a base scalefactor estimation module 114, a band scalefactor estimation module 116, a frequency hole avoidance module 118, and a quantization and encoding module 120.

In operation, frequency domain transformation module 102 receives digital, time-domain based, audio signal samples, e.g., pulse-code modulation (PCM) samples, and performs a time-domain to frequency domain transformation, e.g., a Modified Discrete Cosine Transform (MDCT), that results in digital, frequency-based audio signal samples, or audio signal spectrum values, or spectrum values. Frequency domain transformation module 102 arranges these spectrum values into frequency bands, or scalefactor bands (SFBs), that roughly reflect the Bark scale of the human auditory system. For example, the Bark scale defines 24 critical bands of hearing with frequency band edges located at 20 Hz, 100 Hz, 200 Hz, 300 Hz, 400 Hz, 510 Hz, 630 Hz, 770 Hz, 920 Hz, 1080 Hz, 1270 Hz, 1480 Hz, 1720 Hz, 2000 Hz, 2320 Hz, 2700 Hz, 3150 Hz, 3700 Hz, 4400 Hz, 5300 Hz, 6400 Hz, 7700 Hz, 9500 Hz, 12000 Hz, 15500 Hz. Frequency domain transformation module 102 can group the generated spectrum values in SFBs with similar frequency band edges.

Psychoacoustic module with signal processing toolset 104 receives frames of spectrum values from the frequency domain transformation module 102, e.g., grouped in SFBs, and processes the respective SFBs based on a psychoacoustic model of human hearing. For example, psychoacoustic module 104 can assess the intensity of the spectrum values within the respective SFBs to determine a maximum level of distortion, or maximum tolerant distortion threshold, that can be introduced to the spectrum values in a SFB by the quantization process without significantly degrading the sound quality of the quantized audio signal. As described below, the maximum tolerant distortion threshold produced by psychoacoustic module 104 for each SFB is used by base scalefactor estimation module 114 to generate a base scalefactor for each SFB. Further, psychoacoustic module 104 can process the received spectrum values and can remove, e.g., set to 0, spectrum values from the respective SFBs with frequencies and intensities known, based on the psychoacoustic model of human hearing, to be inaudible to the human ear. Such an approach allows psychoacoustic module 104 to improve the data compression that can be achieved by subsequent spectrum values processing, quantization and encoding processes without significantly impacting the quality of the audio signal.

The signal processing toolset provides additional tools that allow psychoacoustic module with signal processing toolset 104 to further process SFB spectrum values to further increase compression efficiency. For example, in one embodiment the signal processing toolset may be configured with tools such as mid-side stereo (MS) coding and temporal noise shaping (TNS). Other embodiments may be configured with other, or additional, tools, such as perceptual noise substitution. Such toolsets may be selected for use based on, for example, the nature and/or characteristics of the received audio signal, a desired audio quality, a desired final compression size and/or available processing cycles available on the hardware platform on which the embodiment of AAC encoder quantization architecture 100 is deployed. For example, in one embodiment, the signal processing toolset is configured with a low complexity (LC) toolset, resulting in AAC encoder quantization architecture 100 being configured as an advanced audio coding low complexity (AAC LC) audio signal encoder. However, the signal processing toolset may be statically or dynamically configured with other signal processing profiles. Such profiles may include additional signal processing tools and/or control parameters to support additional and/or different processing than that supported by the low complexity (LC) toolset.

AAC quantization and encoding module 106 quantizes and encodes received SFB spectrum values based on the maximum tolerant distortion threshold associated with the SFB. Quantization and encoding module 106 receives SFB spectrum values, maximum tolerant distortion thresholds, SFB energy levels, side information, such as a user selected encoding bitrate, TNS related data, MS related data, etc., from psychoacoustic module and signal processing toolset 104. Details related to modules included in AAC quantization and encoding module 106 are described in greater detail below with respect to FIG. 2 through FIG. 7. Embodiments of process flows performed by modules within AAC quantization and encoding module are described below with respect to FIG. 8 through FIG. 14.

Bitstream packing module 108 receives control parameters, e.g., side data, TNS related data, MS related data, etc., from psychoacoustic module and signal processing toolset 104 and receives control parameters and encoded data from quantization and encoding module 106 and packs the encoded data, SFB scalefactors and/or other header/control data within AAC compatible frames. For example, the control parameters and encoded data received from psychoacoustic module and signal processing toolset 104 and quantization and encoding module 106 may be processed to form a set of predefined syntax elements that are included within each AAC frame. Such information is used by an AAC frame decoder to decode the encoded frames. Details related to an AAC frame format is addressed in detail in ISO/IEC 14496-3:2005 (MPEG-4 Audio).

Figure 2:
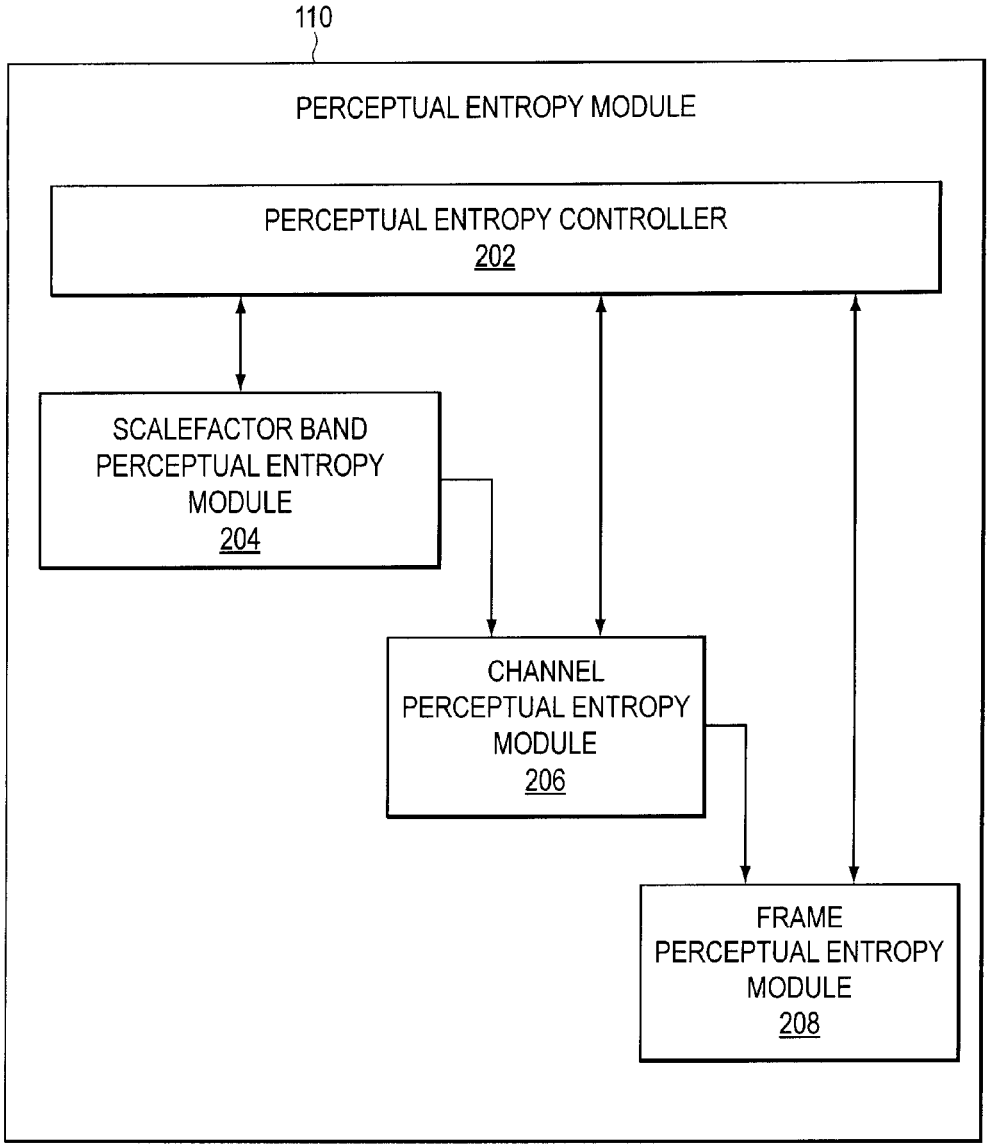
FIG. 2 is an embodiment of the perceptual entropy module of FIG. 1.

FIG. 2 is one embodiment of the perceptual entropy module 110 shown in FIG. 1. Perceptual entropy is a parameter that models the encoding complexity for an AAC frame. The perceptual entropy determinations made by perceptual entropy module 110 are used to allocate bits between the channels in a frame, as described below in greater detail below with respect to target bit count module 112. As shown in FIG. 2, perceptual entropy module 110 can include a perceptual entropy controller 202, a SFB perceptual entropy module 204, a channel perceptual entropy module 206, and a frame perceptual entropy module 208.

Figure 9:
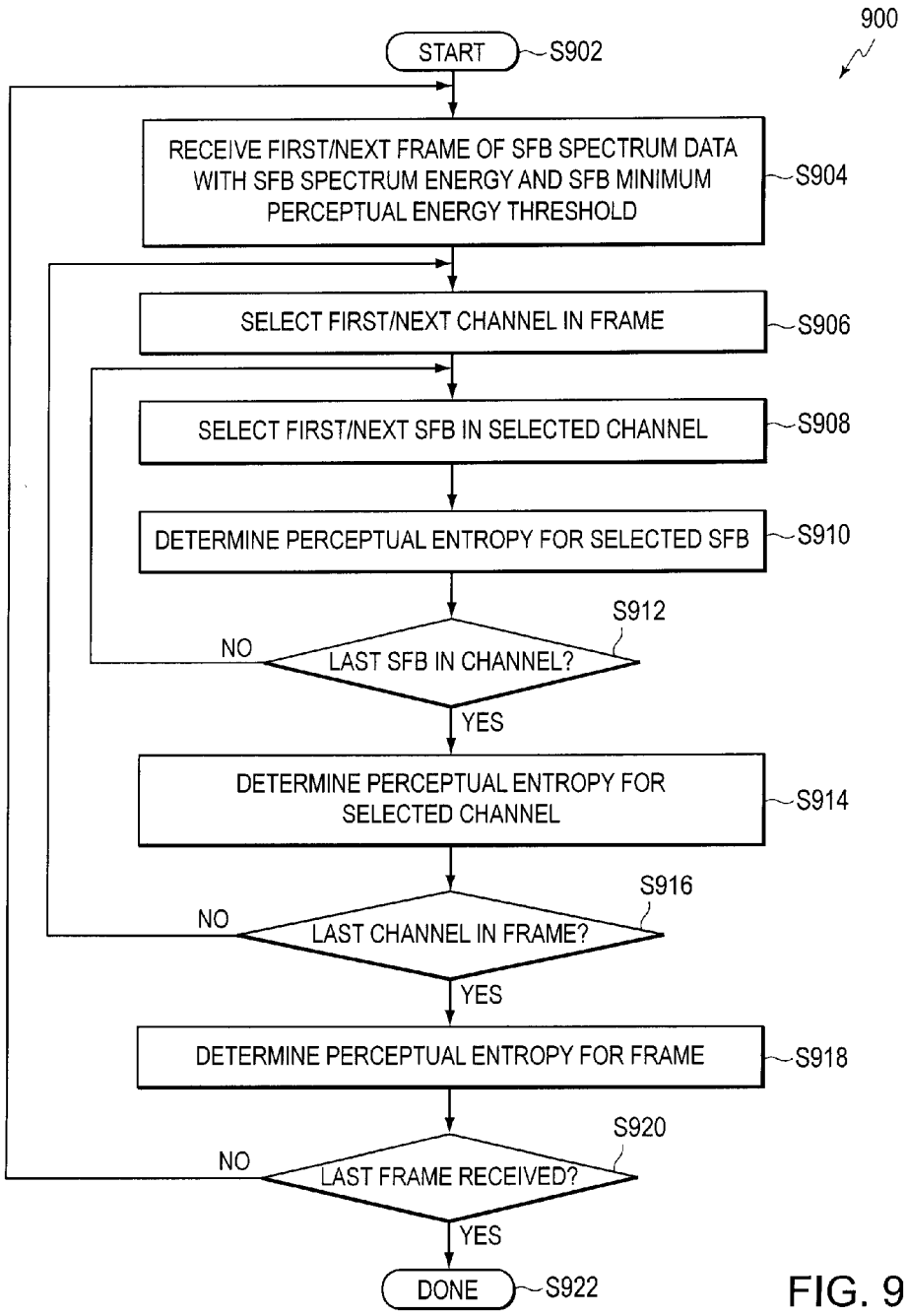
FIG. 9 is a flow-chart of a process for determining frame perceptual entropy levels performed by the perceptual entropy module of FIG. 2.

In one embodiment, perceptual entropy controller 202 maintains a set of static and/or dynamically updated control parameters that can be used by perceptual entropy controller 202 to invoke the other modules included in perceptual entropy module 110 to perform operations, as described below, in accordance with the control parameters and predetermined process flows, such as the process flow described below with respect to FIG. 9. Perceptual entropy controller 202 communicates with psychoacoustic module and signal processing toolset 104 to receive frame spectrum data, SFB spectrum energy levels and SFB minimum perceptual energy thresholds. Further, perceptual entropy controller 202 communicates with and receives status updates from the respective modules of perceptual entropy module 110 to allow perceptual entropy controller 202 to control operation of the perceptual entropy determining process. As described below with respect to equations [1] through [3], the perceptual entropy determining process can be implemented in multiple stages, each stage relying upon an output generated by a previous stage. In FIG. 2, and FIG. 9, the perceptual entropy determining process is described as a 3-stage process; however, different embodiments may implement the perceptual entropy determining process with any number of stages consistent with the described approach, for example, by combining multiple stages into a single stage, or by splitting a single stage into multiple stages.

Scalefactor band (SFB) perceptual entropy module 204 can be invoked by perceptual entropy controller 202 to perform a first stage of the perceptual entropy determining process in which a perceptual entropy for each SFB in a received frame of spectrum data is determined, e.g., based on equation [1], below.

$$Pe_{sfb} = \log\left(\frac{\text{Energy}_{sfb}}{\text{Threshold}_{sfb}}\right) \quad \text{[EQ. 1]}$$

Where $Pe_{sfb}$ is the perceptual entropy for a SFB;

$\text{Energy}_{sfb}$ is the energy of spectrum values in the SFB; and $\text{Threshold}_{sfb}$ is a minimum perceptual energy threshold for the SFB.

Channel perceptual entropy module 206 can be invoked by perceptual entropy controller 202 to perform a second stage of the perceptual entropy determining process in which a perceptual entropy for channel in a received frame of spectrum data is determined, e.g., based on equation [2], below.

$$Pe_{ch} = \sum_{sfb=0}^{sfbCnt} Pe_{sfb} \quad \text{[EQ. 2]}$$

Where $Pe_{ch}$ is the perceptual entropy for a channel in a frame;

sfbCnt is the number of SFBs in the channel; and $$\sum_{sfb=0}^{sfbCnt} Pe_{sfb}$$

is a sum of the perceptual entropies in each of the SFBs in the channel.

Frame perceptual entropy module 208 can be invoked by perceptual entropy controller 202 to perform a third stage of the perceptual entropy determining process in which a perceptual entropy for the received frame of spectrum data is determined, e.g., based on equation [3], below.

$$Pe = \sum_{ch=0}^{ChNum} Pe_{ch} \quad \text{[EQ. 3]}$$

Where Pe is the perceptual entropy for a frame;

ChNum is the number of channels in the frame, e.g., 2 (left and right); and $$\sum_{ch=0}^{ChNum} Pe_{ch}$$

is a sum of the perceptual entropies in each of the channels in the frame.

Figure 3:
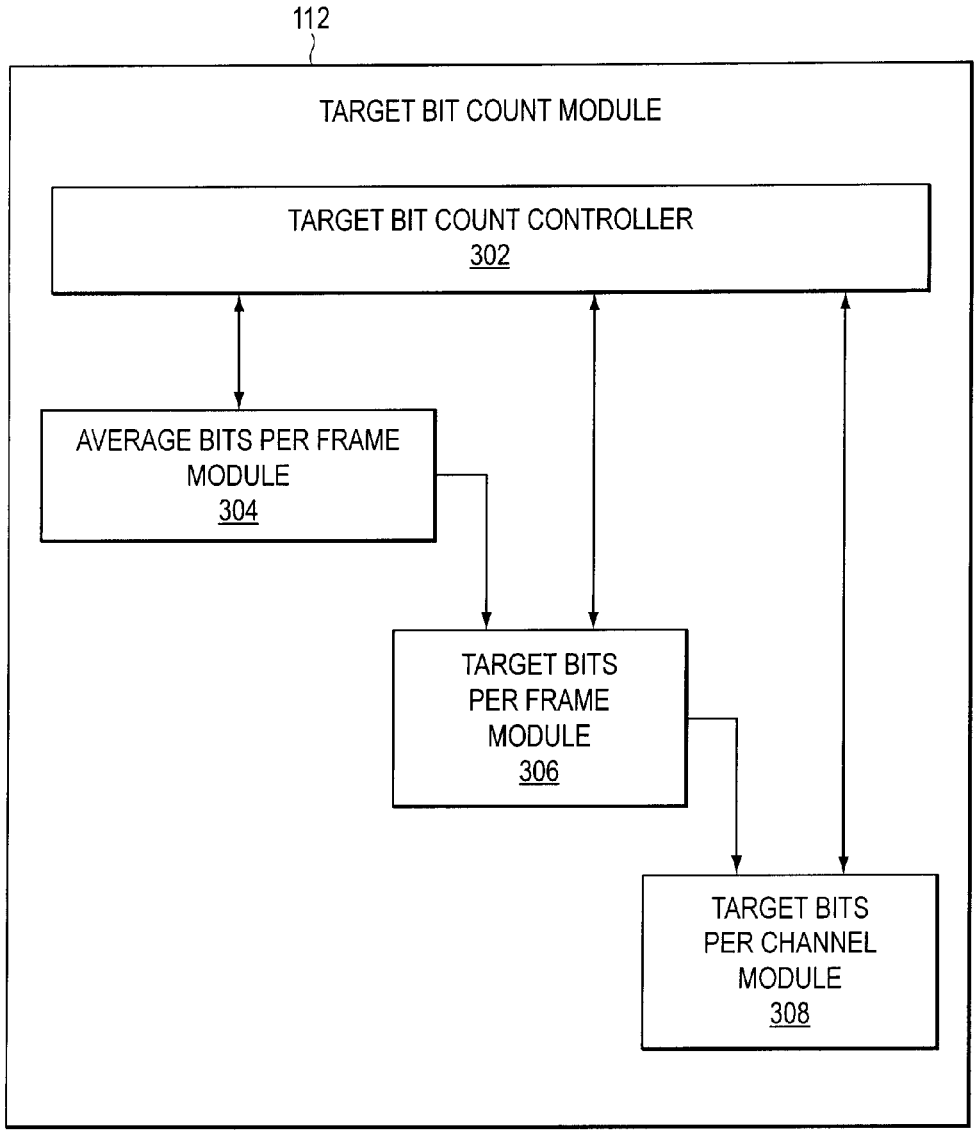
FIG. 3 is an embodiment of the target bit count module of FIG. 1.
Figure 10:
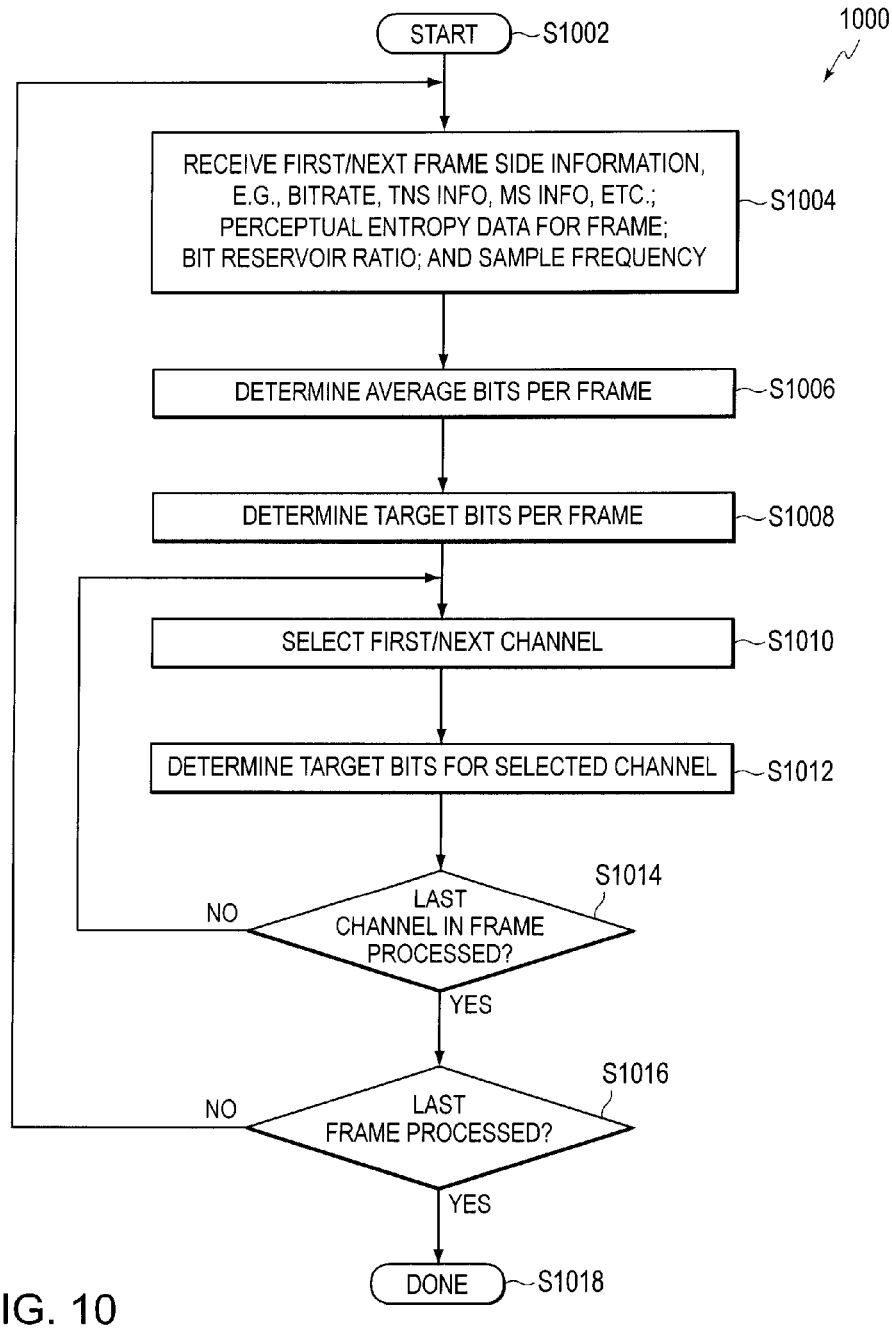
FIG. 10 is a flow-chart of a process for determining target bit counts performed by the target bit count module of FIG. 3.

FIG. 3 is one embodiment of the target bit count module shown in FIG. 1. As shown in FIG. 3, target bit count module 112 can include a target bit count controller 302, an average bits per frame module 304, a target bits per frame module 306, and a target bits per channel module 308. The determined target bits per channel, or tgtBitsPerCh, determined as described below with respect to FIG. 3 and FIG. 10, is used to control the quantization and encoding process described below with respect to FIG. 7 and FIG. 14. If a count of bits in a quantized and encoded channel of a frame is not less than or equal to the tgtBitsPerCh value determined for the channel as described below, a global scalefactor adjustment is applied to all SFBs associated with the channel and the quantization and encoding process is repeated until the quantized and encoded channel is less than or equal to the determined tgtBitsPerCh value for the channel.

In one embodiment, target bit count controller 302 maintains a set of static and/or dynamically updated control parameters that can be used by target bit count controller 302 to invoke the other modules included in target bit count module 112 to perform operations, as described below, in accordance with the control parameters and predetermined process flows, such as the process flow described below with respect to FIG. 10. Target bit count controller 302 communicates with psychoacoustic module and signal processing toolset 104 to receive frame side information, e.g., bit rate, TNS information, and MS information. Further, target bit count controller 302 communicates with perceptual entropy module 110 to receive channel perceptual entropy data and frame perceptual entropy data associated with a received frame of spectrum data. In addition, target bit count controller 302 communicates with and receives status updates from the respective modules of target bit count module 112 to allow target bit count controller 302 to control operation of the target bit count determining process. As described below with respect to equations [4] through [6], the target bit count determining process can be implemented in multiple stages, each stage relying upon an output generated by a previous stage. In FIG. 3 and FIG. 10, the target bit count determining process is described as a 3-stage process; however, different embodiments may implement the target bit count determining process with any number of stages consistent with the described approach, for example, by combining multiple stages into a single stage, or by splitting a single stage into multiple stages.

Average bits per frame module 304 is invoked by target bit count controller 302 to perform a first stage of the target bit count determining process in which an average number of bits per encoded frame is determined, e.g., based on equation [4], below.

$$avgBitsPerFrame = \frac{1024}{sampleFrequency} * bitrate \qquad \text{[EQ. 4]}$$

Where avgBitsPerFrame is the average number of bits per encoded frame;

1024 is the number of samples per frame;

sampleFrequency is a frame sampling rate in samples per second; and bitrate is the target encoded frame bit rate in bits per second.

Target bits per frame module 306 can be invoked by target bit count controller 302 to perform a second stage of the target bit count determining process in which a target bit count for an encoded frame is determined, e.g., based on equation [5], below.

$$tgtBitsPerFrame = avgBitsPerFrame + bitRsvRatio * bitRsvCnt \qquad \text{[EQ. 5]}$$

Where tgtBitsPerFrame is the determined # of target bits per encoded frame;

avgBitsPerFrame is the result of equation [4] above;

bitRsvRatio is an allowed percentage of bits that can be borrowed from running bit reservoir for use by a frame, as described below; and bitRsvCnt is the current number of bits in the bit reservoir, as described below.

The bit reservoir is a running count of bits maintained by the quantizing and encoding module 120 during the quantization and encoding process described below with respect to FIG. 7 and FIG. 14, below. For example, if a particular encoded channel frame produced by quantizing and encoding module 120 during the quantization and encoding process is below a target bits per channel tgtBitsPerCh value, as described below, a difference between the tgtBitsPerCh and the actual bit count is added to the bit reservoir. As shown in equation [5], a predetermined fraction of the current bit reservoir, bitRsvRatio, e.g. 0.30 is included within the tgtBitsPerFrame value allocated to a frame. The bitRsvRatio may be either a positive value, e.g. +0.3, to allow the determined tgtBitsPerFrame to borrow bits from the bit reservoir, or a positive value, e.g. +0.3, to allow the determined tgtBitsPerFrame to borrow bits from the bit reservoir. Adjusting the positive/negative sign and the magnitude of bitRsvRatio, is one technique that can be used to tune the described quantization and encoding process.

Target bits per channel module 308 can be invoked by target bit count controller 302 to perform a third stage of the target bit count determining process in which a target bit count for an encoded channel frame is determined, e.g., based on equation [6], below.

$$tgtBitsPerCh = (tgtBitsPerFrame - sideInfoBits) * \frac{Pe_{ch}}{\sum_{ch=1}^{chNum} Pe_{ch}} \qquad \text{[EQ. 6]}$$

Where tgtBitsPerCh is the determined # of target bits per encoded channel;

tgtBitsPerFrame is the result of equation [5] above;

sideInfoBits is a determined number of side information bits that must be included in the frame to allow a decoder to decode the frame;

$Pe_{ch}$ is the perceptual entropy for a channel in a frame from equation [2] above; and $$\sum_{ch=0}^{ChNum} Pe_{ch}$$

is the sum of the perceptual entropies in each of the channels in the frame, or the perceptual entropy for a frame, Pe, from equation [3] above.

As described above, if a count of bits in a quantized and encoded channel of a frame is not less than or equal to the tgtBitsPerCh value determined for the channel, a global scalefactor adjustment is applied to all SFBs associated with the channel frame and the quantization and encoding process is repeated until the quantized and encoded channel frame is less than or equal to the determined tgtBitsPerCh value for the channel frame.

Figure 4:
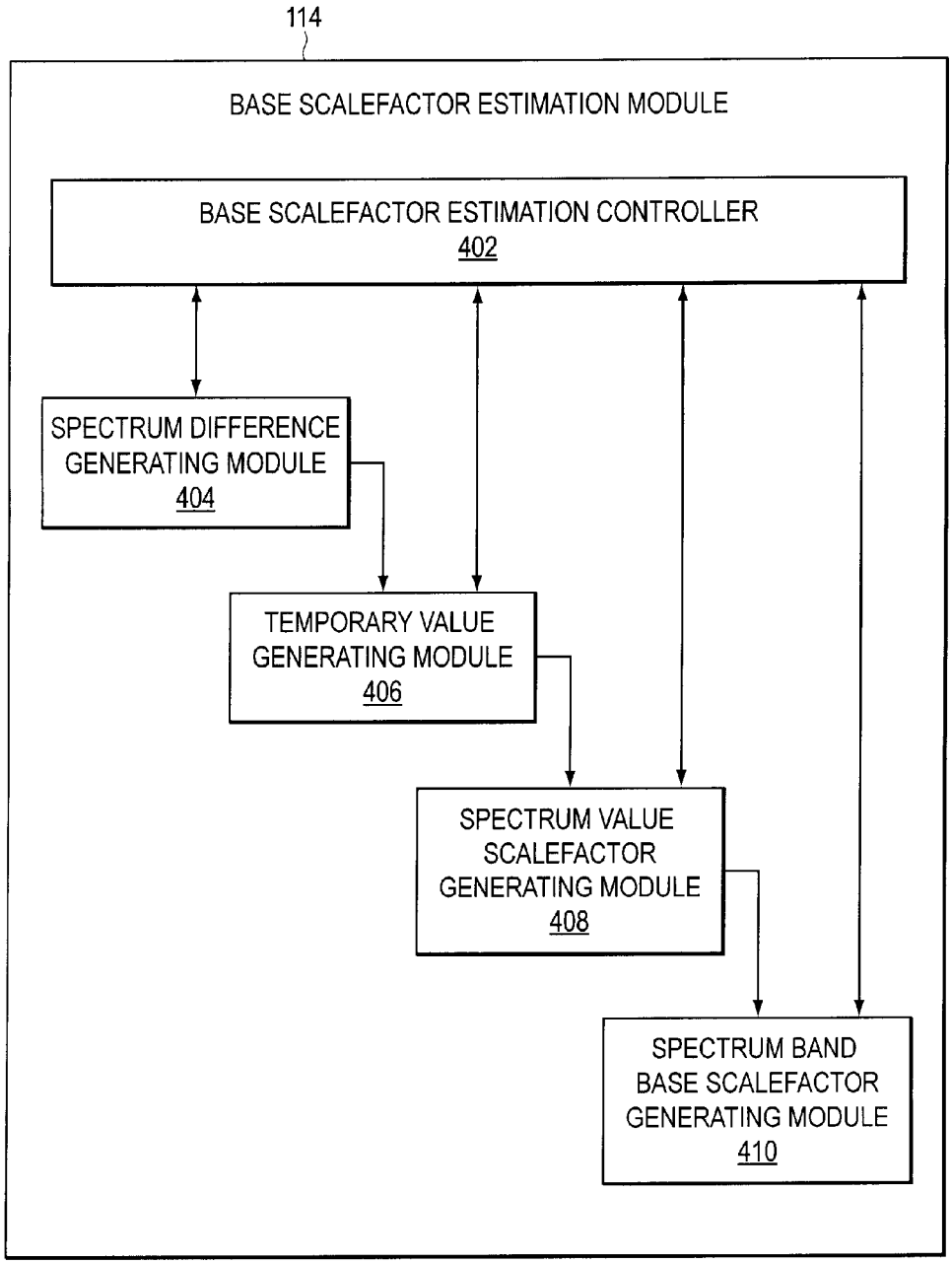
FIG. 4 is an embodiment of the base scalefactor estimation module of FIG. 1.

FIG. 4 is one embodiment of the base scalefactor estimation module 114 shown in FIG. 1. The base scalefactor estimation module 114 is used to implement embodiments of a base scalefactor estimation approach, detail of which are described below with respect to equation [7] through equation [10] and with respect to FIG. 11, below. As shown in FIG. 4, base scalefactor estimation module 114 can include a base scalefactor estimation controller 402, a spectrum difference generating module 404, a temporary value generating module 406, a spectrum value scalefactor generating module 408, and a spectrum band base scalefactor generating module 410. As described in greater detail below with respect to FIG. 5 and FIG. 12, the estimated base scalefactor is adjusted by a delta scalefactor estimate that is based, in part, on global scalefactor adjustments applied to the previous quantized/encoded channel frame, to estimate a scalefactor for an SFB.

Figure 11:
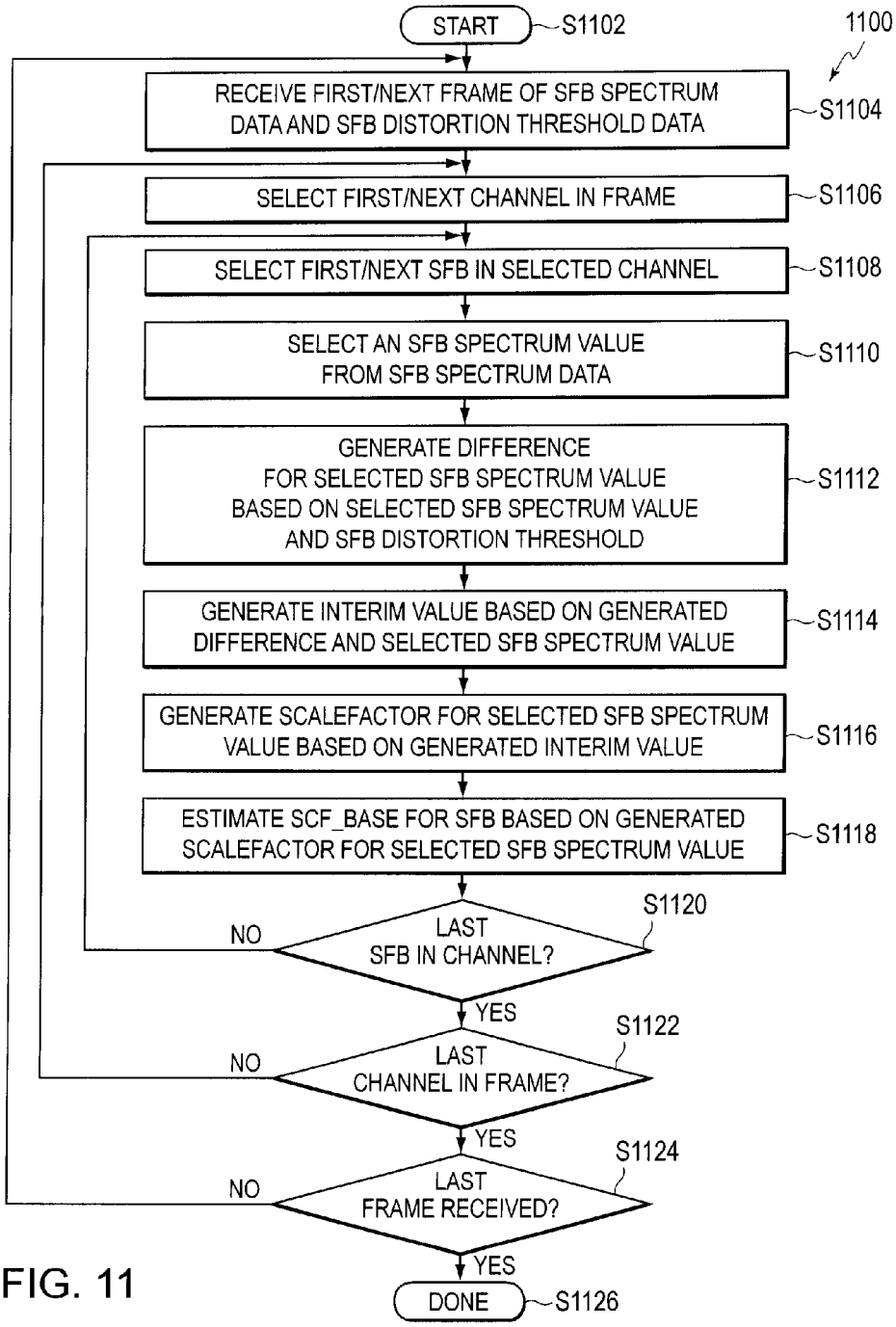
FIG. 11 is a flow-chart of a process for estimating a base scalefactor performed by the base scalefactor estimation module of FIG. 4.

In operation, base scalefactor estimation controller 402 maintains a set of static and/or dynamically updated control parameters that can be used by base scalefactor estimation controller 402 to invoke the other modules included in base scalefactor estimation module 114 to perform operations, as described below, in accordance with the control parameters and predetermined process flows, such as the process flow described below with respect to FIG. 11. Base scalefactor estimation controller 402 communicates with psychoacoustic module and signal processing toolset 104 to receive SFB spectrum data and a maximum distortion threshold for each SFB for use as described below. As described below with respect to equations [7] through [10], the base scalefactor estimation process can be implemented in multiple stages, each stage relying upon an output generated by a previous stage. In FIG. 4 and FIG. 11, the base scalefactor estimation process is described as a 4-stage process; however, different embodiments may implement the scalefactor estimation process with any number of stages consistent with the described approach, for example, by combining multiple stages into a single stage, or by splitting a single stage into multiple stages.

Spectrum difference generating module 404 is invoked by base scalefactor estimation controller 402 to perform a first stage of the base scalefactor estimation process in which a distortion level, or difference $\mathrm{Diff}_k$, for a selected SFB spectrum value is determined based on a received maximum tolerant distortion threshold for the SFB and a sum of the spectrum values in the SFB. For example, an equation that may be implemented by spectrum difference generating module 404 to achieve such a result based on such input values is represented at equation [7] below.

$$Diff_k^2 = \mathrm{Distortion}_{sfb} * |X(k)|^{\frac{1}{2}} \Big/ \sum_{k=1}^{n} |X(k)|^{\frac{1}{2}} \quad X(k) \neq 0 \qquad \text{[EQ. 7]}$$

Where $\mathrm{Diff}_k$ is a distortion level for a selected SFB spectrum value X(k) based on the received maximum tolerant distortion threshold and a sum of the spectrum values in the SFB;

$\mathrm{Distortion}_{sfb}$ is the SFB maximum tolerant distortion threshold for the whole SFB;

X(k) is the selected SFB spectrum value; and $$\sum_{k=1}^{n} |X(k)|$$

is a sum of the spectrum values in the SFB.

A derivation and further explanation of equation [7] is provided in U.S. Non-provisional application Ser. No. 12/626, 161, incorporated by reference herein.

Temporary value generating module 406 is invoked by base scalefactor estimation controller 402 to initiate a second stage of the base scalefactor estimation process by generating an interim process value based on the difference, $\mathrm{Diff}_k$, generated by the spectrum difference generating module 404, as described above, and based on the selected SFB spectrum value for which the difference was obtained. For example, an equation that may be implemented by temporary value generating module 406 to achieve such a result based on such input values is represented at equation [8] below.

$$a = 3 * \left( \left( 1 + 0.5 * \frac{Diff_k}{|X(k)|} \right)^{\frac{1}{2}} - 1 \right) \qquad \text{[EQ. 8]}$$

Where a is the generated temporary value.

A derivation and further explanation of equation [8] is provided in U.S. Non-provisional application Ser. No. 12/626, 161, incorporated by reference herein.

Spectrum value scalefactor generating module 408 is invoked by scalefactor estimation controller 402 to complete the third stage of the scalefactor estimation process by generating a scalefactor for the selected SFB spectrum value based on the interim process value generated by the temporary value generating module 406, as described above, and based on a predetermined fraction. In one embodiment, this predetermined fraction, for example, may be a common predetermined fraction associated with each of the SFB spectrum values in a SFB. In another embodiment, the predetermined fraction may be a value which has been statistically pre-determined based on the SFB spectrum values themselves and/or can be a predetermined value associated with the SFB by the AAC encoding profile being implemented. For example, an equation that may be implemented by spectrum value scalefactor generating module 408 to achieve such a result based on such input values is represented at equation [9] below.

$$Scf1 = |X(k)| * \left( \frac{a}{\text{fraction}} \right)^{\frac{4}{3}} \qquad \text{[EQ. 9]}$$

Where Scf1 is the scalefactor for a selected spectrum value X(k) within the SFB; and fraction is a statistically predetermined fraction, e.g., 0.3.

A derivation and further explanation of equation [9] is provided in U.S. Non-provisional application Ser. No. 12/626, 161, incorporated by reference herein.

Spectrum band base scalefactor generating module 410 is invoked by scalefactor estimation controller 402 to perform a fourth stage of the scalefactor estimation process in which a base scalefactor for a SFB is generated based on the scalefactor generated by spectrum value scalefactor generating module 408 for the selected SFB spectrum value. For example, an equation that may be implemented by spectrum band scalefactor generating module 410 to achieve such a result based on such an input value is represented at equation [10] below.

$$\mathrm{Scf_base} = 4 * \log_2(\mathrm{Scf1}) \qquad \text{[EQ. 10]}$$

Where Scf_base is the determined base scalefactor for the SFB.

A derivation and further explanation of equation [10] is provided in U.S. Non-provisional application Ser. No. 12/626, 161, incorporated by reference herein. As described in greater detail below with respect to FIG. 5 and FIG. 12, the estimated base scalefactor is adjusted by a delta scalefactor estimate that is based, in part, on global scalefactor adjustments applied to the previous quantized/encoded channel frame, to estimate a scalefactor for an SFB.

Figure 5:
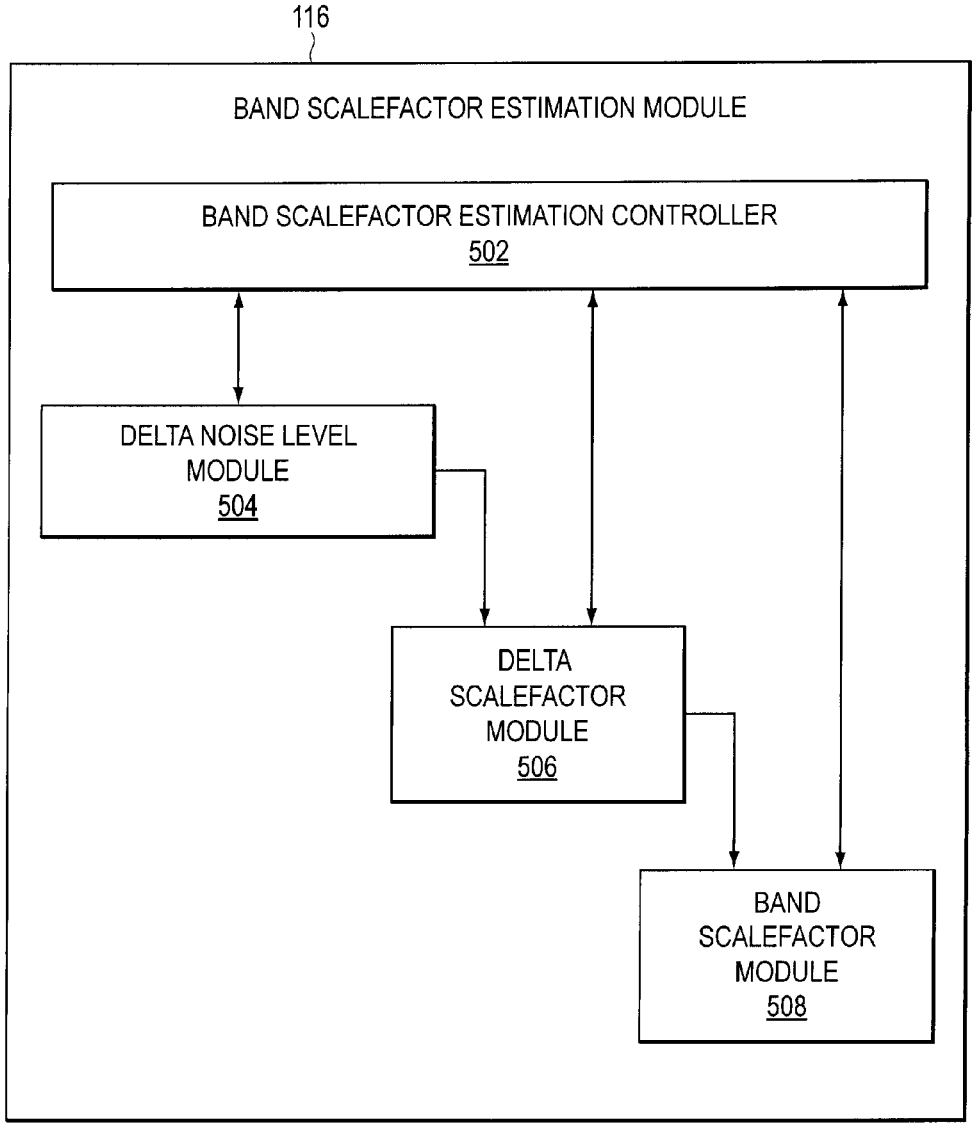
FIG. 5 is an embodiment of the band scalefactor estimation module of FIG. 1.

FIG. 5 is one embodiment of the band scalefactor estimation module 116 shown in FIG. 1. The band scalefactor estimation module 116 is used to implement embodiments of the described band scalefactor estimation approach, details of which are described below with respect to equation [11] and equation [12] and with respect to FIG. 12. As shown in FIG. 5, band scalefactor estimation module 116 can include a band scalefactor estimation controller 502, a delta noise level module 504, a delta scalefactor module 506, and a band scalefactor module 508. As described in greater detail below, the estimated base scalefactor, estimated as described above with respect to FIG. 4 and equations [7] through equation [10], is adjusted by the delta scalefactor estimate, which is based in part on global scalefactor adjustments applied to the SFBs of the previous quantized/encoded channel frame, to estimate a scalefactor for an SFB, or band scalefactor, Scf_band.

In operation, band scalefactor estimation controller 502 maintains a set of static and/or dynamically updated control parameters that can be used by band scalefactor estimation controller 502 to invoke the other modules included in band scalefactor estimation module 116 to perform operations, as described below, in accordance with the control parameters and predetermined process flows, such as the process flow described below with respect to FIG. 12. Band scalefactor estimation controller 502 communicates with base scalefactor estimation controller 402 to receive the base scalefactors estimated for the SFBs of the frame, as described above with respect to FIG. 4. As described below with respect to equations [11] and [12], the band scalefactor estimation process can be implemented in multiple stages, each stage relying upon an output generated by a previous stage. In FIG. 5 and FIG. 11, the band scalefactor estimation process is described as a 3-stage process; however, different embodiments may implement the scalefactor estimation process with any number of stages consistent with the described approach, for example, by combining multiple stages into a single stage, or by splitting a single stage into multiple stages.

Delta noise level module 504 is invoked by band scalefactor estimation controller 502 to perform a first stage of the band scalefactor estimation process in which a delta noise level, i.e., a change in noise level across all SFBs in a frame as a result of a change in the scalefactor, is generated. For example, an equation that may be implemented by delta noise level module 504 to determine such a delta noise level is represented at equation [11] below.

$$deltaNoiseLevel = \frac{4}{3}\text{fraction} * 2^{\frac{3}{16}Scf_base} * \left(2^{\frac{3}{16}(Scf_delta)} - 1\right) \quad \text{[EQ. 11]}$$

Where deltaNoiseLevel is the determined delta noise level;

Scf_base is the base scalefactor determined using equation [10];

Scf_delta is the delta scalefactor; and

Fraction is a predetermined fraction, e.g., 0.3.

In equation 11, above, if the SFB for which the deltaNoiseLevel is being determined is the first SFB of a first frame in a channel, the value of Scf_delta is assumed to be zero. If the SFB for which the deltaNoiseLevel is being determined is the first SFB of a subsequent frame in a channel, the value of Scf_delta is set to be the sum of the global scalefactor adjustments, FrameScfAdj, applied to the previous quantized/encoded frame of the channel, as described below with respect to FIG. 7 and FIG. 14.

Delta scalefactor module 506 is invoked by band scalefactor estimation controller 502 to complete the second stage of the band scalefactor estimation process, the generation of a delta scalefactor, which is a determined adjusted increase to the base scalefactor for an SFB. The maximum acceptable distortion generated by psychoacoustic module and signal processing toolset 104 is too restricted for encoding at middle or low bitrates. Therefore, to reach the target compression rate, the base scalefactor is increased, thereby slightly increasing the level of allowed distortion in the quantized and encoded signal. This adjustment to the base scalefactor, Scf_base, is referred to a delta scalefactor, Scf_delta.

To avoid perceptual variations in sound quality, the scalefactor increase should introduce the same additional level of distortion across the respective SFBs of a channel frame. Therefore, it can be assumed that the deltaNoiseLevel value of equation [11] remains the same across the respective SFBs of the channel frame. Therefore, for each of the second to last SFB of a channel frame, delta scalefactor module 506 generates an SCF_delta based on the relationship described above at equation [11], the deltaNoiseLevel determined for the first SFB of the channel frame, and the SCF_base determined for each corresponding SFB of the channel frame.

Band scalefactor generating module 508 is invoked by band scalefactor estimation controller 502 to perform a fourth stage of the band scalefactor estimation process in which a band scalefactor is generated for each SFB in a channel frame, based on the Scf_base and Scf_delta values for each respective SFB of the channel frame, based on equation [12] below.

$$Scf_band = Scf_base + Scf_delta \quad \text{[EQ. 12]}$$

Where Scf_band is the determined band scalefactor for the SFB.

Figure 6:
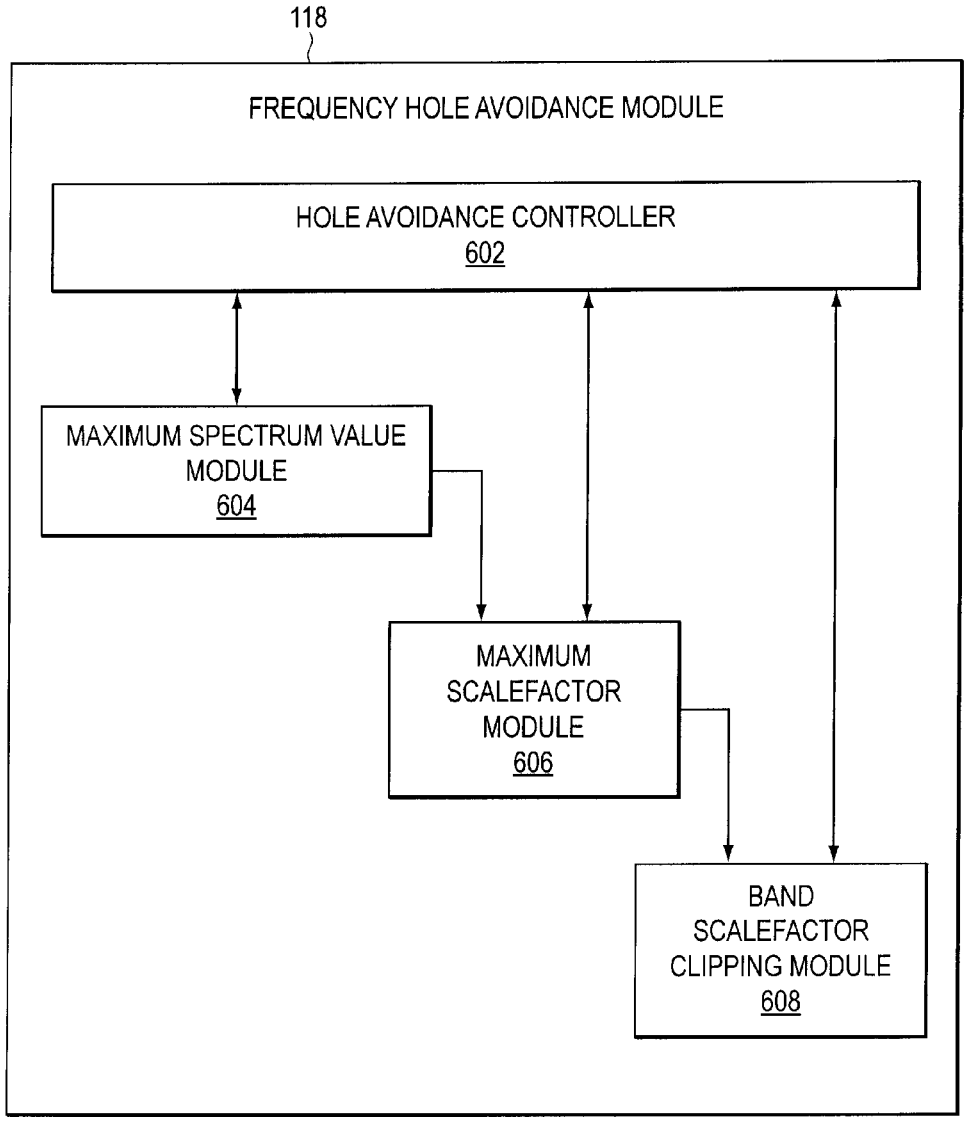
FIG. 6 is an embodiment of the frequency hole avoidance module of FIG. 1.

FIG. 6 is one embodiment of the frequency hole avoidance module 118 shown in FIG. 1. The energy of some SFBs will be less than the distortion threshold allowed by an Scf_band produced as described above with respect to FIG. 5. This is because the addition of the Scf_delta to the Scf_base increases the threshold distortion allowed by the Scf_band and can cause the spectrum in low energy bands to be quantized to zero, thereby creating a frequency hole. Such frequency holes result in audible quality loss and, therefore, should be avoided. Therefore, the frequency hole avoidance module 118 implements a clipping routine that assures that the Scf_band estimated for a SFB does not result in a frequency hole at that SFB. As shown in FIG. 6, frequency hole avoidance module 118 can include a hole avoidance controller 602, a maximum spectrum value module 604, a maximum scalefactor module 606, and a band scalefactor clipping module 608.

Figure 13:
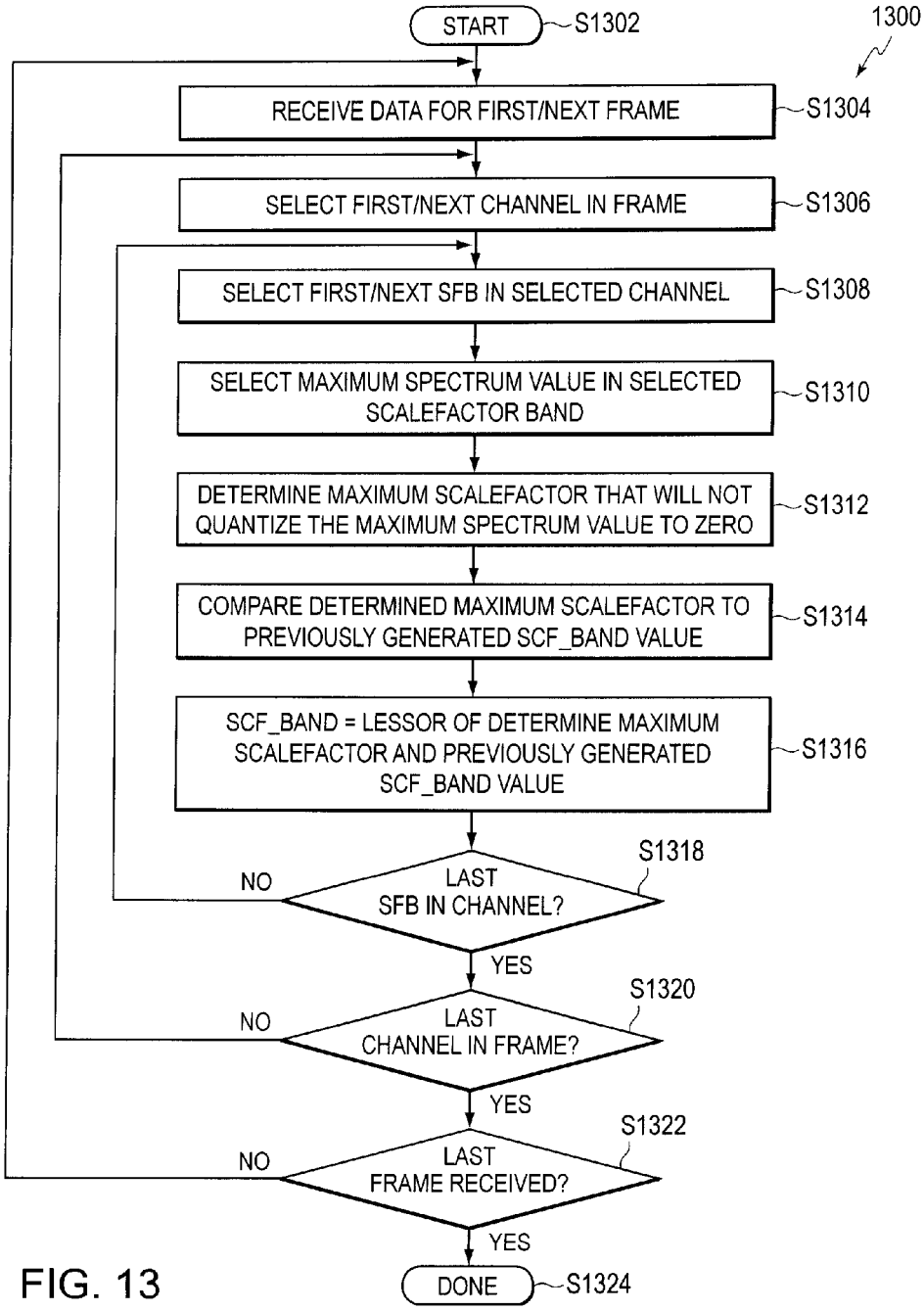
FIG. 13 is a flow-chart of a process for avoiding frequency holes performed by the frequency hole avoidance module of FIG. 6.

In operation, hole avoidance controller 602 maintains a set of static and/or dynamically updated control parameters that can be used by hole avoidance controller 602 to invoke other modules included in frequency hole avoidance module 118 to perform operations, as described below, in accordance with the control parameters and predetermined process flows, such as the process flow described below with respect to FIG. 13. Hole avoidance controller 602 communicates with band scalefactor estimation controller 502 to receive the Scf_band estimated for a SFB and communicates with psychoacoustic module and signal processing toolset 104 to receive SFB spectrum values. As described below with respect to equation [13], the hole avoidance process can be implemented in multiple stages, each stage relying upon an output generated by a previous stage. In FIG. 6 and FIG. 13, the band scalefactor estimation process is described as a 3-stage process; however, different embodiments may implement the hole avoidance process with any number of stages consistent with the described approach, for example, by combining multiple stages into a single stage, or by splitting a single stage into multiple stages.

Maximum spectrum value module 604 is invoked by hole avoidance controller 602 to parse the spectrum values of a single SFB to determine the largest spectrum value in the SFB. Maximum scalefactor module 606 is invoked by hole avoidance controller 602 to generate, e.g., according to the AAC quantization formula defined in ISO 14496 subpart 4 (Ref [1]), the maximum scalefactor $Scf_{max}$ which will not quantize the largest spectrum value in the SFB.

Band scalefactor clipping module 608 is invoked by hole avoidance controller 602 to compare the maximum scalefactor $Scf_{max}$ with the determined SCF band value determined, for example, as described above with respect to FIG. 5, and to select a scalefactor Scf for the SFB that is the minimum of the $Scf_{max}$. value and Scf_band value, as shown in equation [13].

$$Scf=\min(Scf_band, Scf_{max}) \quad \text{[EQ. 13]}$$

Figure 7:
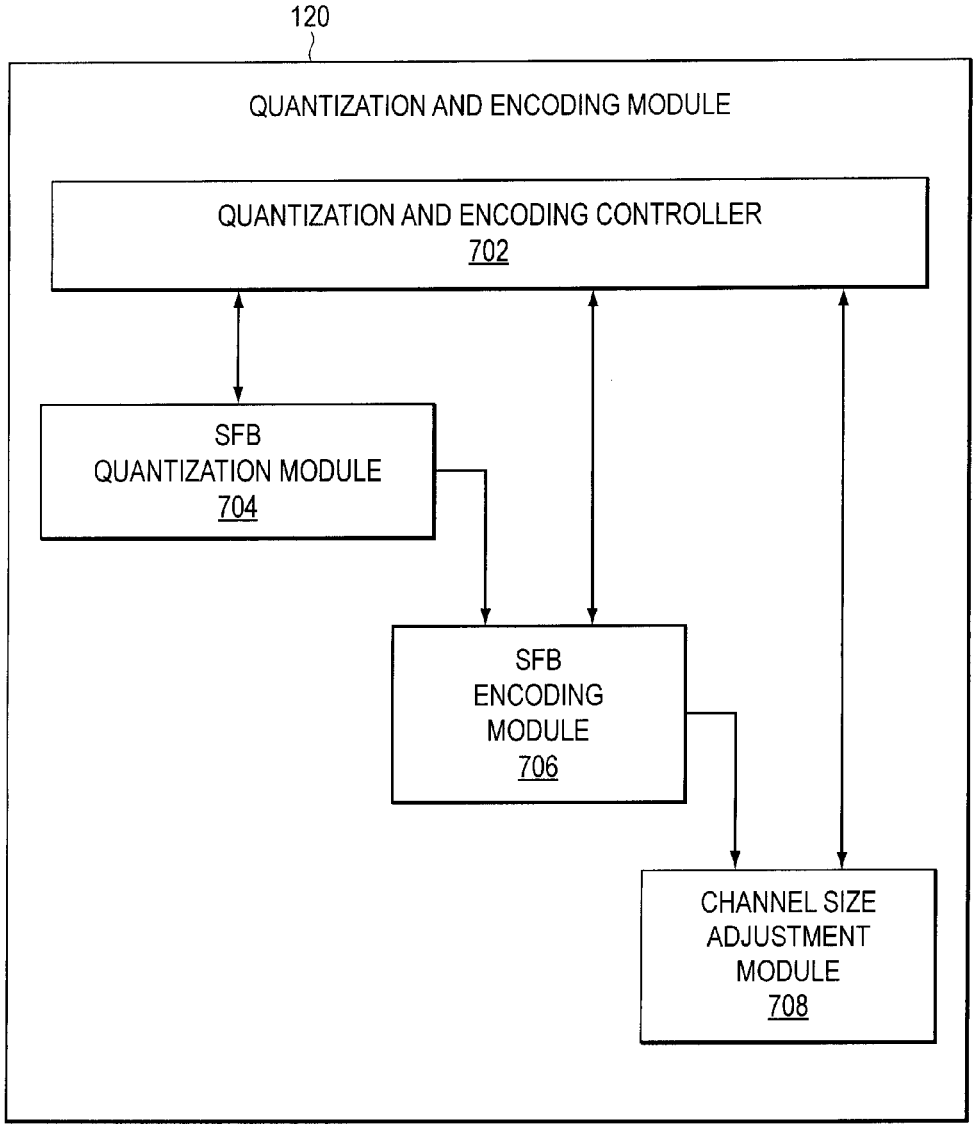
FIG. 7 is an embodiment of the quantization and encoding module of FIG. 1.

FIG. 7 is one embodiment of the quantization and encoding module 120 shown in FIG. 1. Quantization and encoding module 120 quantizes each SCB in a channel frame using the estimated scalefactor, Scf, e.g., determined for each SFB, as described above with respect to FIG. 6, and encodes the quantized SFBs for the channel frame using a selected encoding processes, e.g., Huffman coding, to produce an encoded channel frame of data. If the encoded bit count for the encoded channel frame is larger than the channel target bit count, tgtBitsPerCh, e.g., determined as described above with respect to FIG. 3, the Scf for each SFB in the channel is increased by a global scalefactor step, globalScfStep, and the quantization and encoding process is repeated until the encoded bit count meets the target allocated bit count. A sum of the global scalefactor steps applied to each channel frame, FrameScfAdj, is stored for use as an approximation for the delta scalefactor, Scf_delta, in determining the delta noise level, deltaNoiseLevel, as described above with respect to FIG. 5, used to determine the Scf_delta for the first SFB of the next frame of the channel. As shown in FIG. 7, quantization and encoding module 120 can include a quantization and encoding controller 702, an SFB quantization module 704, an SFB encoding module 706, and a channel size adjustment module 708.

In operation, quantization and encoding controller 702 maintains a set of static and/or dynamically updated control parameters that can be used by quantization and encoding controller 702 to invoke other modules included in quantization and encoding module 120 to perform operations, as described below, in accordance with the control parameters and predetermined process flows, such as the example process flow described below with respect to FIG. 14. Quantization and encoding controller 702 communicates with psychoacoustic module and signal processing toolset 104 to receive frame spectrum values. Further, quantization and encoding controller 702 communicates with hole avoidance controller 602 to receive a scalefactor, Scf, for each SFB in a channel frame to be quantized and encoded. In addition, quantization and encoding controller 702 communicates with target bit count controller 302 to receive a channel target bit count, tgtBitsPerCh, for each channel in a frame to be quantized and encoded. As described below with respect to FIG. 7, the quantization and encoding process can be implemented in multiple stages, each stage relying upon an output generated by a previous stage. In FIG. 7 and FIG. 14, the quantization and encoding process is described as a 3-stage process; however, different embodiments may implement the quantization and encoding process with any number of stages consistent with the described approach, for example, by combining multiple stages into a single stage, or by splitting a single stage into multiple stages.

SFB quantization module 704 is invoked by quantization and encoding controller 702 to quantize each SFB of a channel frame based on the scalefactor, Scf, for each of the respective channel frame SFBs.

SFB encoding module 706 is invoked by quantization and encoding controller 702 to encode each SFB of each channel of a frame using a selected coding technique, e.g., Huffman coding, based on the scalefactor, Scf, for each of the respective channel frame SFBs.

Channel size adjustment module 708 is invoked by quantization and encoding controller 702 to compare the bit count of an encoded channel frame, i.e., the bit count of all encoded SFBs in a channel of an encoded frame, to the channel target bit count, tgtBitsPerCh, e.g., determined as described above with respect to FIG. 3. If the encoded bit count for the encoded channel frame is larger than the channel target bit count, tgtBitsPerCh, the Scf for each SFB in the channel is increased by a global scalefactor step, globleScfStep, and the quantization and encoding process is repeated until the encoded bit count meets the target allocated bit count. A running sum of the global scalefactor steps applied to each channel frame is GlobalChnlScfAdjSum. GlobalChnlScfAdjSum is stored to FrameScfAdj, as described above with respect to FIG. 5. FrameScfAdj is used as an approximation for the delta scalefactor, Scf_delta, in determining the delta noise level, deltaNoiseLevel for the first SFB of the next frame of the channel.

Figure 8:
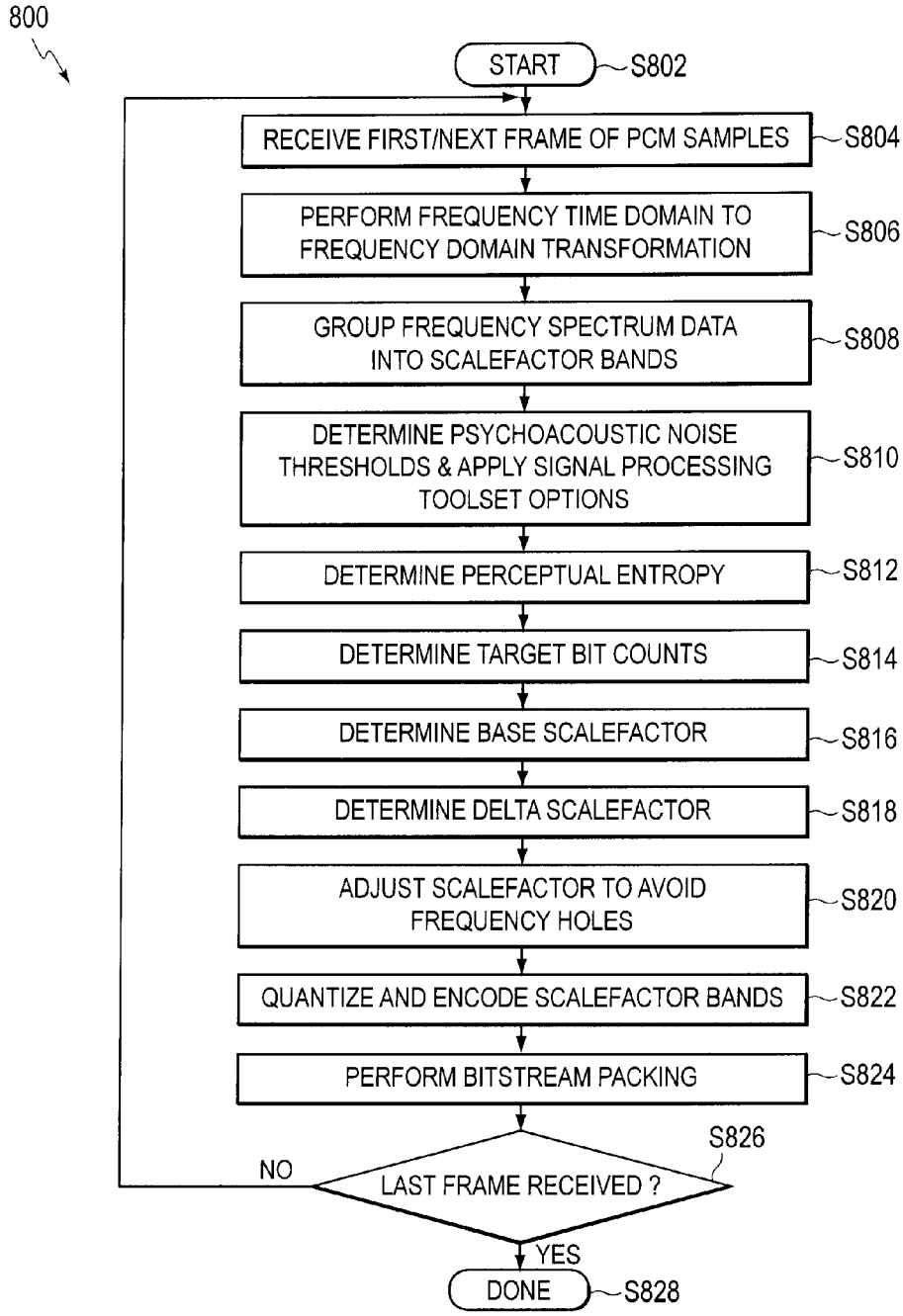
FIG. 8 is a high level flow-chart of an quantization and encoding process implemented using the AAC encoder quantization architecture of FIG. 1.

FIG. 8 is a high level flow-chart of an example of the quantization and encoding process implemented using the AAC encoder quantization architecture described above with respect to FIG. 1. As shown in FIG. 8, operation of process 800 begins at S802 and proceeds to S804.

At S804, frequency domain transformation module 102 receives a first/next frame of digital, time-domain based, audio signal samples, e.g., pulse-code modulation samples, and operation of the process continues at S806.

At S806, frequency domain transformation module 102 performs a time-domain to frequency-domain transformation, e.g., a modified discrete cosine transform, on the received digital, time-domain based, audio signal samples that results in digital, frequency-based audio signal samples, or audio signal spectrum values, or spectrum values, and operation of the process continues at S808.

At S808, frequency domain transformation module 102 arranges the spectrum values into frequency bands, or SFBs, that reflect a level of perception end as the Bark scale of the human auditory system, and operation of the process continues at S810.

At S810, psychoacoustic module and signal processing toolset 104 processes the SFB spectrum values to eliminate inaudible data and to generate a maximum tolerant distortion threshold for each SFB based on a psychoacoustic model, such as of human hearing. Further, one or more signal processing techniques associated with a selected AAC encoding profile, e.g., MS coding, TNS, etc., are applied to the respective SFBs to further compress the respective SFB spectrum values and/or to further refine the maximum tolerant distortion threshold for the respective SFBs, and operation of the process continues at S812.

At S812, perceptual entropy module 110 is invoked to determine a perceptual entropy for the received frame, and to determine a perceptual entropy for each channel in the received frame, as described below with respect to FIG. 9, and operation of the process continues at S814.

At S814, target bit count module 112 is invoked to determine a target bit count for each channel of the received frame, as described below with respect to FIG. 10, and operation of the process continues at S816.

At S816, base scalefactor estimation module 114 is invoked to determine a base scalefactor, Scf_base, for each SFB in the received frame, as described below with respect to FIG. 11, and operation of the process continues at S818.

At S818, band scalefactor estimation module 116 is invoked to adjust the base scalefactor, Scf_base, for each SFB in the received frame to determine a band scalefactor, Scf_band, for each SFB in the received frame, as described below with respect to FIG. 12, and operation of the process continues at S820.

At S820, frequency hole avoidance module 118 is invoked to assess the band_scalefactor, Scf_band, determined for each SFB against a maximum safe scalefactor determined for each respective SFB, and to clip band scalefactors that exceed the maximum to a level that avoids the introduction of a frequency hole at the SFB during the quantization process, as described below with respect to FIG. 13, and operation of the process continues at S822.

At S822, quantization and encoding module 120 is invoked to quantize and encode the spectrum values in each SFB of the frame, as described below with respect to FIG. 14, and operation of the process continues at S824.

At S824, the bitstream packing module 108 is invoked to pack the encoded frames with corresponding frame side information into AAC compliant frames, as described above with respect to FIG. 1, and operation of the process continues at S826.

At S826, if the last frame of digital, time-domain based, audio signal samples has been received, operation of the process concludes at S828; otherwise, operation of the process continues at S804.

FIG. 9 is a flow-chart of an example of a process for determining frame perceptual entropy levels performed by the perceptual entropy module 110, described above with respect to FIG. 2. As shown in FIG. 9, operation of process 900 begins at S902 and proceeds to S904.

At S904, perceptual entropy module 110 receives, e.g., from psychoacoustic module with signal processing toolset 104, a first/next frame of SFB spectrum data, an SFB spectrum energy value for each SFB in the received frame, and an SFB minimum perceptual energy threshold for each SFB in the received frame, and operation of the process continues at S906.

At S906, perceptual entropy controller 202 selects a first/next channel in the received frame, and operation of the process continues at S908.

At S908, perceptual entropy controller 202 selects a first/next SFB in the selected channel frame, and operation of the process continues at S910.

At S910, perceptual entropy controller 202 invokes scalefactor band perceptual entropy module 204 to determine a perceptual entropy for the selected SFB, e.g., as described above with respect to equation [1], and operation of the process continues at S912.

At S912, if perceptual entropy controller 202 determines that the last SFB in the selected channel has been processed, operation of the process continues at S914; otherwise, operation of the process continues at S908.

At S914, perceptual entropy controller 202 invokes channel perceptual entropy module 206 to determine a perceptual entropy for the selected channel, e.g., as described above with respect to equation [2], and operation of the process continues at S916.

At S916, if perceptual entropy controller 202 determines that the last channel in the received frame has been processed, operation of the process continues at S918; otherwise, operation of the process continues at S906.

At S918, perceptual entropy controller 202 invokes frame perceptual entropy module 206 to determine a perceptual entropy for the received frame, e.g., as described above with respect to equation [3], and operation of the process continues at S920.

At S920, if perceptual entropy controller 202 determines that the last frame to be received has been processed, operation of the process concludes at S922; otherwise, operation of the process continues at S904.

FIG. 10 is a flow-chart of an example of a process for determining a target bits per channel, or tgtBitsPerCh, value for each channel in a received frame of spectrum data, as performed by the target bit count module 112, described above with respect to FIG. 3. The determined tgtBitsPerCh value is used to control the quantization and encoding process of the respective channels in the frame, as described below with respect to FIG. 14. As shown in FIG. 10, operation of process 1000 begins at S1002 and proceeds to S1004.

At S1004, target bit count module 112 receives for a first/next frame, e.g., from psychoacoustic module with signal processing toolset 104, side information, e.g., a bit rate, TNS related information, MS coding related information, etc., a sampling frequency and a bit reservoir ratio value. Further, target bit count module 112 receives for the first/next frame, a channel perceptual entropy value for each channel in the frame and a frame perceptual entropy value generated by perceptual entropy module 110, as described above with respect to FIG. 9. Once the required data and control parameters have been received, operation of the process continues at S1006.

At S1006, target bit count controller 302 invokes average bits per frame module 304 to determine an average bits per encoded frame, avgBitsPerFrame, as described above with respect to equation [4], and operation of the process continues at S1008.

At S1008, target bit count controller 302 invokes target bits per frame module 306 to determine a target number of bits per encoded frame, tgtBitsPerFrame, as described above with respect to equation [5], and operation of the process continues at S1010.

At S1010, target bit count controller 302 selects a first/next frame channel, and operation of the process continues at S1012.

At S1012, target bit count controller 302 invokes target bits per channel module 308 to determine a target number of bits per encoded channel, tgtBitsPerCh, as described above with respect to equation [6], and operation of the process continues at S1014.

At S1014, if target bit count controller 302 determines that the last channel in the frame has been processed, operation of the process continues at S1016; otherwise, operation of the process continues at S1010.

At S1016, if target bit count controller 302 determines that the last frame has been processed, operation of the process concludes at S1018; otherwise, operation of the process continues at S1004.

FIG. 11 is a flow-chart of an example of a process for estimating a base scalefactor performed by the base scalefactor estimation module 114, as described above with respect to FIG. 4. As shown in FIG. 11, operation of process 1100 begins at S1102 and proceeds to S1104.

At S1104, base scalefactor estimation controller 402 receives from psychoacoustic module with signal processing toolset 104 a first/next frame of SFB spectrum values and a maximum tolerant distortion threshold for each SFB in the received frame, and operation of the process continues at S1106.

At S1106, base scalefactor estimation controller 402 selects a first/next channel in the received frame, and operation of the process continues at S1108.

At S1108, base scalefactor estimation controller 402 selects a first/next SFB in the selected channel, and operation of the process continues at S1110.

At S1110, base scalefactor estimation controller 402 selects a spectrum value from the selected SFB, and operation of the process continues at S1112.

At S1112, base scalefactor estimation controller 402 invokes spectrum difference generating module 404 to perform a first stage of the scalefactor estimation process in which a distortion level, or difference, for the selected SFB spectrum value is determined based on the received maximum tolerant distortion threshold and a sum of the spectrum values in the SFB, as described above with respect to equation [7], and operation of the process continues at S1114.

At S1114, base scalefactor estimation controller 402 invokes temporary value generating module 406 to perform a second stage of the base scalefactor estimation process by generating an interim process value based on the difference generated at S1112 and the selected SFB spectrum value, as described above with respect to equation [8], and operation of the process continues at S1116.

At S1116, base scalefactor estimation controller 402 invokes spectrum value scalefactor generating module 408 to perform a third stage of the base scalefactor estimation process by generating a scalefactor for the selected SFB spectrum value based on the interim process value generated at S1114, and as described above with respect to equation [9], and operation of the process continues at S1118.

At S1118, base scalefactor estimation controller 402 invokes spectrum band base scalefactor generating module 410 to perform a fourth stage of the base scalefactor estimation process by generating a base scalefactor, Scf_base, for the SFB based on the spectrum value scalefactor generated at S1112, and as described above with respect to equation [10], and operation of the process concludes at S1120.

At S1120, if base scalefactor estimation controller 402 determines that the last SFB of the selected channel has been processed, operation of the process continues at S1122; otherwise, operation of the process continues at S1108.

At S1122, if base scalefactor estimation controller 402 determines that the last channel of the received frame has been processed, operation of the process continues at S1124; otherwise, operation of the process continues at S1106.

At S1124, if base scalefactor estimation controller 402 determines that the last frame has been processed, operation of the process completes at S1126; otherwise, operation of the process continues at S1104.

Figure 12:
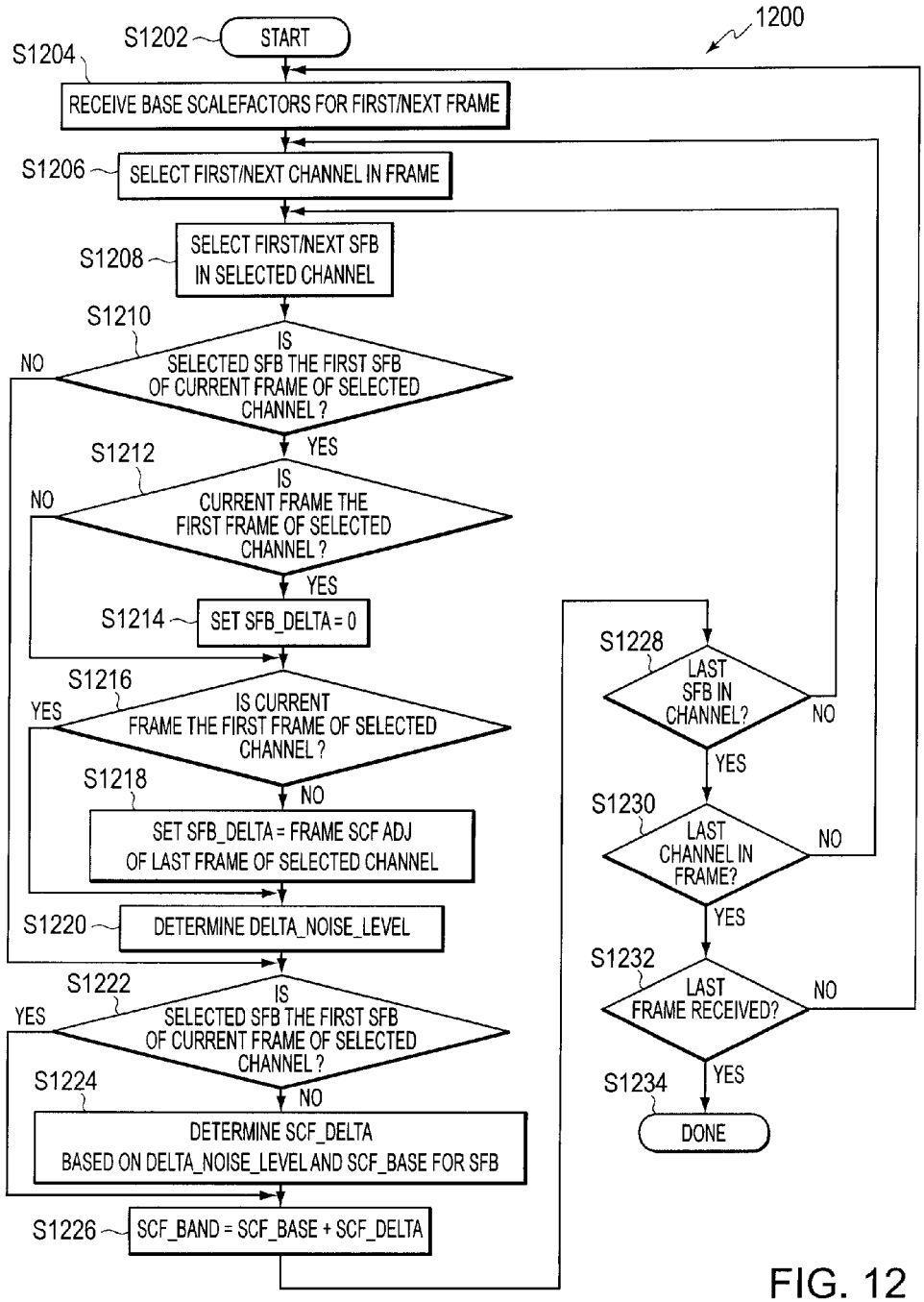
FIG. 12 is a flow-chart of a process for estimating a band scalefactor performed by the band scalefactor estimation module of FIG. 5.

FIG. 12 is a flow-chart of an example of a process for estimating a band scalefactor performed by the band scalefactor estimation module of FIG. 5. As shown in FIG. 12, operation of process 1200 begins at S1202 and proceeds to S1204.

At S1204, band scalefactor estimation controller 502 receives base scalefactors, Scf_base, estimated for each of the SFBs of a first/next frame, e.g., generated as described above with respect to FIG. 4 and FIG. 11, and operation of the process continues at S1206.

At S1206, band scalefactor estimation controller 502 selects a first/next channel in the current frame, and operation of the process continues at S1208.

At S1208, band scalefactor estimation controller 502 selects a first/next SFB in the selected channel, and operation of the process continues at S1210.

At S1210, if band scalefactor estimation controller 502 determines that the selected SFB is the first SFB of the current frame of the selected channel, operation of the process continues at S1212; otherwise, operation of the process continues at S1222.

At S1212, if band scalefactor estimation controller 502 determines that the current frame is the first frame of the selected channel, operation of the process continues at S1214; otherwise, operation of the process continues at S1216.

At S1214, band scalefactor estimation controller 502 sets the delta scalefactor value SFB_delta to 0, operation of the process continues at S1216.

At S1216, if band scalefactor estimation controller 502 determines that the current frame is not the first frame of the selected channel, operation of the process continues at S1218; otherwise, operation of the process continues at S1220.

At S1218, band scalefactor estimation controller 502 sets the delta scalefactor value, SFB_delta, for the selected SFB to the sum of the global scalefactor steps, FrameScfAdj, applied to the last frame of the currently selected channel, processed by quantization and encoding module 120, as described above with respect to FIG. 7, and below with respect to FIG. 14, and operation of the process continues at S1220.

At S1220, band scalefactor estimation controller 502 invokes delta noise level module 504 to determine a delta noise level, deltaNoiseLevel, for the selected SFB, as described above with respect to equation [11], and operation of the process continues at S1222.

At S1222, if band scalefactor estimation controller 502 determines that the selected SFB is not the first SFB of the current frame of the selected channel, operation of the process continues at S1224; otherwise, operation of the process continues at S1226.

At S1224, band scalefactor estimation controller 502 invokes delta scalefactor module 506 to determine a delta scalefactor, Scf_delta, for the selected SFB, based on the deltaNoiseLevel value determined at S1220, the base scalefactor value, Scf_base, determined for the SFB, as described above with respect to FIG. 11, and the relationship defined by equation [11]. Once an Scf_delta value is determined, operation of the process continues at S1226.

At S1226, band scalefactor estimation controller 502 invokes band scalefactor module 508 to determine a band scalefactor, Scf_band, for the selected SFB, based on the Scf_delta value determined at S1224, for the selected SFB, the base scalefactor value, Scf_base, determined for the SFB, as described above with respect to FIG. 11, and equation [12]. Once an Scf_band value is determined, operation of the process continues at S1228.

At S1228, if band scalefactor estimation controller 502 determines that the last SFB of the selected channel has been processed, operation of the process continues at S1230; otherwise, operation of the process continues at S1208.

At S1230, if band scalefactor estimation controller 502 determines that the last channel of the received frame has been processed, operation of the process continues at S1232; otherwise, operation of the process continues at S1206.

At S1232, if band scalefactor estimation controller 502 determines that the last frame has been processed, operation of the process completes at S1234; otherwise, operation of the process continues at S1204.

FIG. 13 is a flow-chart of an example of a process for avoiding frequency holes performed by the frequency hole avoidance module 118, as described above with respect to FIG. 6. As shown in FIG. 13, operation of process 1300 begins at S1302 and proceeds to S1304.

At S1304, hole avoidance controller 602 communicates with band scalefactor estimation controller 502 to receive the Scf_band vales estimated for the SFBs of a first/next frame and communicates with psychoacoustic module and signal processing toolset 104 to receive SFB spectrum values for the first/next frame, and operation of the process continues at S1306.

At S1306, hole avoidance controller 602 selects a first/next channel in the current frame, and operation of the process continues at S1308.

At S1308, hole avoidance controller 602 selects a first/next SFB in the selected channel, and operation of the process continues at S1310.

At S1310, hole avoidance controller 602 invokes maximum spectrum value module 604 to determine a maximum spectrum value in the selected SFB, and operation of the process continues at S1312.

At S1312, hole avoidance controller 602 invokes maximum scalefactor module 606 to determine a maximum scalefactor for the selected SFB that will not quantize the SFB spectrum values to zero, and operation of the process continues at S1314.

At S1314, hole avoidance controller 602 invokes band scalefactor clipping module 608 to compare the determined maximum scalefactor and the previously generated Scf_band for the SFB, and operation of the process continues at S1316.

At S1316, band scalefactor clipping module 608 sets the scalefactor, Scf, for the SFB to the lesser of the maximum scalefactor and the previously generated Scf_band for the SF, e.g., based on equation [13], and operation of the process continues at S1318.

At S1318, if hole avoidance controller 602 determines that the last SFB of the selected channel has been processed, operation of the process continues at S1320; otherwise, operation of the process continues at S1308.

At S1320, if hole avoidance controller 602 determines that the last channel of the current frame has been processed, operation of the process continues at S1322; otherwise, operation of the process continues at S1306.

At S1322, if hole avoidance controller 602 determines that the last frame has been processed, operation of the process completes at S1324; otherwise, operation of the process continues at S1304.

Figure 14:
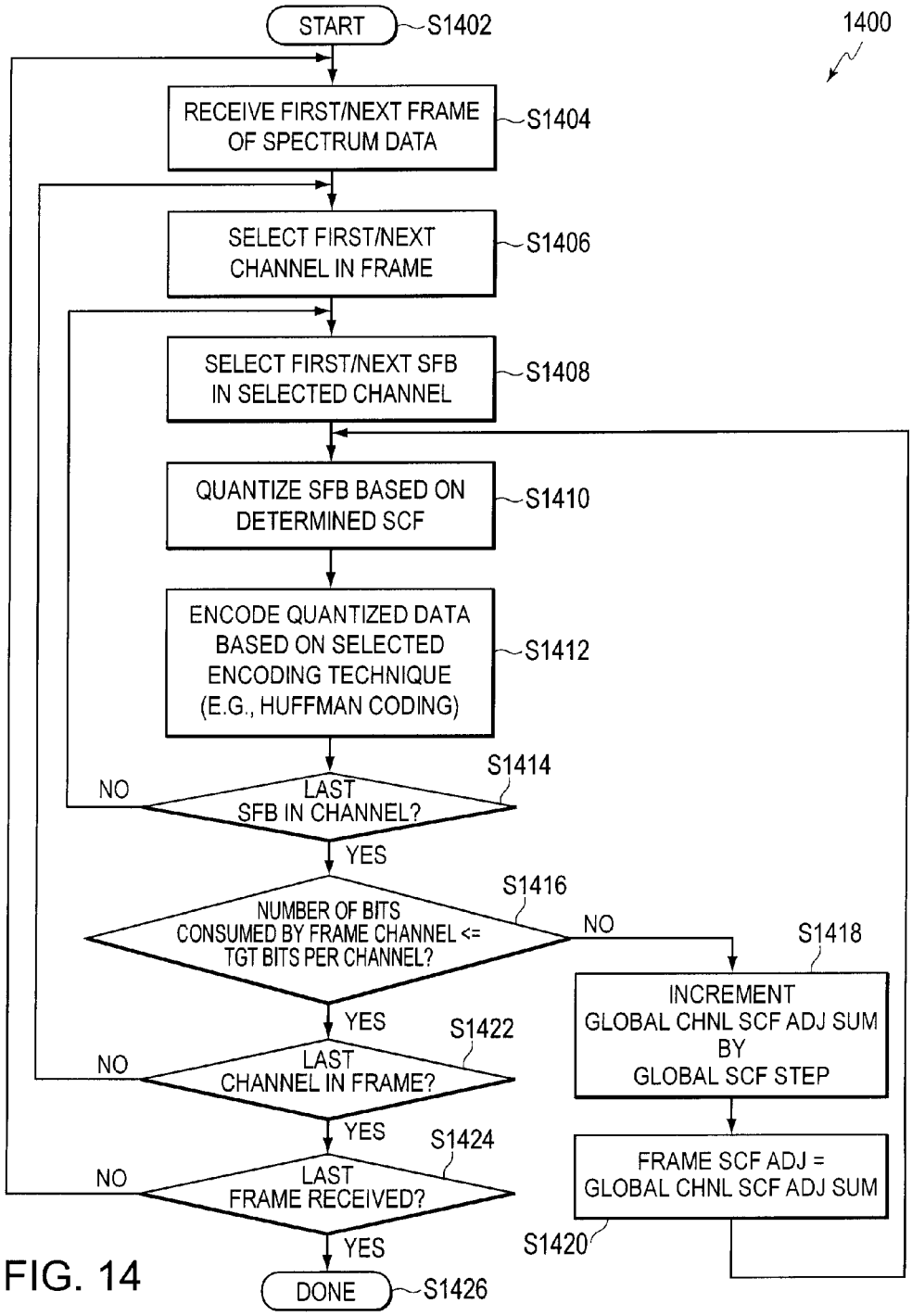
FIG. 14 is a flow-chart of a quantization and encoding process performed by the quantization and encoding module of FIG. 7.

FIG. 14 is a flow-chart of an example of a quantization and encoding process performed by the quantization and encoding module described above with respect to FIG. 7. As shown in FIG. 14, operation of process 1400 begins at S1402 and proceeds to S1404.

At S1404, quantization and encoding controller 702 communicates with psychoacoustic module and signal processing toolset 104 to receive SFB spectrum values for a first/next frame; communicates with hole avoidance controller 602 to receive a scalefactor, Scf, for each SFB in the first/next frame; and communicates with target bit count controller 302 to receive a channel target bit count, tgtBitsPerCh, for each channel in the first/next frame to be quantized and encoded.

At S1406, quantization and encoding controller 702 selects a first/next channel in the current frame, and operation of the process continues at S1408.

At S1408, quantization and encoding controller 702 selects a first/next SFB in the selected channel, and operation of the process continues at S1410.

At S1410, quantization and encoding controller 702 invokes SFB quantization module 704 to quantize the selected SFB based on the Scf determined for the SFB by frequency hole avoidance module 118, and operation of the process continues at S1412.

At S1412, quantization and encoding controller 702 invokes SFB encoding module 706 to encode the quantized SFB based on a selected encoding technique, e.g., Huffman coding, and operation of the process continues at S1414.

At S1414, if quantization and encoding controller 702 determines that the last SFB in the selected channel has been encoded, operation of the process continues at S1416; otherwise, operation of the process continues at S1408.

At S1416, quantization and encoding controller 702 invokes channel size adjustment module 708 to determine a number of bits consumed by the current encoded channel. If channel size adjustment module 708 determines that the number of bits consumed by the current encoded channel is less than or equal to the channel target bit count, tgtBitsPerCh, operation of the process continues at S1422; otherwise, operation of the process continues at S1418.

At S1418, channel size adjustment module 708 increments the global scalefactor adjustment value, GlobalChnlScfAdjSum, by a global scalefactor step, GlobalScfStep, and operation of the process continues at S1420.

At S1420, channel size adjustment module 708 stores the incremented global scalefactor adjustment value, GlobalChnlScfAdjSum, to the frame scalefactor adjustment value, FrameScfAdj. As described above with respect to FIG. 5, the frame scalefactor adjustment value, FrameScfAdj is used as an approximation for the delta scalefactor value, Scf_delta, in determining the delta noise level, deltaNoiseLevel, for the first SFB of the next frame of the channel. Once GlobalChnlScfAdjSum and is stored to FrameScfAdj, each Scf for each SFB of the currently selected channel is incremented by GlobalChnlScfAdjSum, and operation of the process continues at S1410.

At S1422, if quantization and encoding controller 702 determines that the last channel of the current frame has been processed, operation of the process continues at S1424; otherwise, operation of the process continues at S1406.

At S1424, if quantization and encoding controller 702 determines that the last frame has been processed, operation of the process completes at S1426; otherwise, operation of the process continues at S1404.

It is noted that in the embodiments, the process flows described with respect to FIG. 8 through FIG. 14, may be combined, or grouped, in any manner to efficiently receive and process frames of digital, time-domain based, audio signal samples, e.g., pulse-code modulation (PCM) samples, to produce AAC compliant encoded frames. For example, with respect to one or more aspects of the respective process flows described above with respect to FIG. 8 through FIG. 14, SFBs and/or channels within a frame may be processed in parallel, or in series, and/or using combinations thereof.

Figure 15:
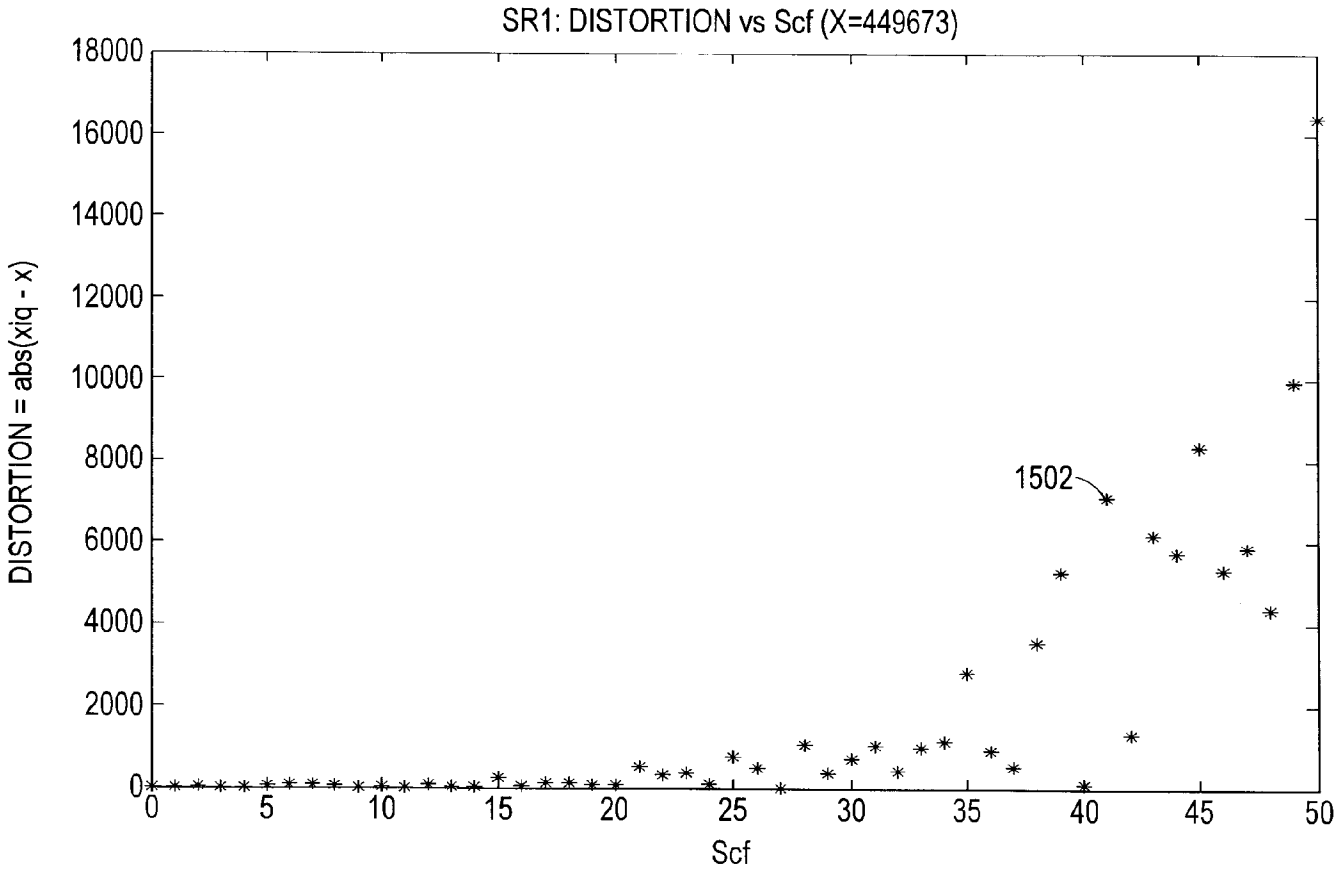
FIG. 15 is a plot of calculated real distortion levels introduced to a stream of encoded audio spectrum values as a result of quantizing the audio spectrum values with scalefactors selected from a set of linearly increasing scalefactors.

FIG. 15 is a plot of real distortion levels 1502 introduced to a stream of encoded audio spectrum values as a result of quantizing the audio spectrum values with scalefactors selected from a set of linearly increasing scalefactors. As shown in FIG. 15, distortion levels (represented on the y-axis) in quantized data increases when larger scalefactors (represented on the x-axis) are used in the quantization process.

Figure 16:
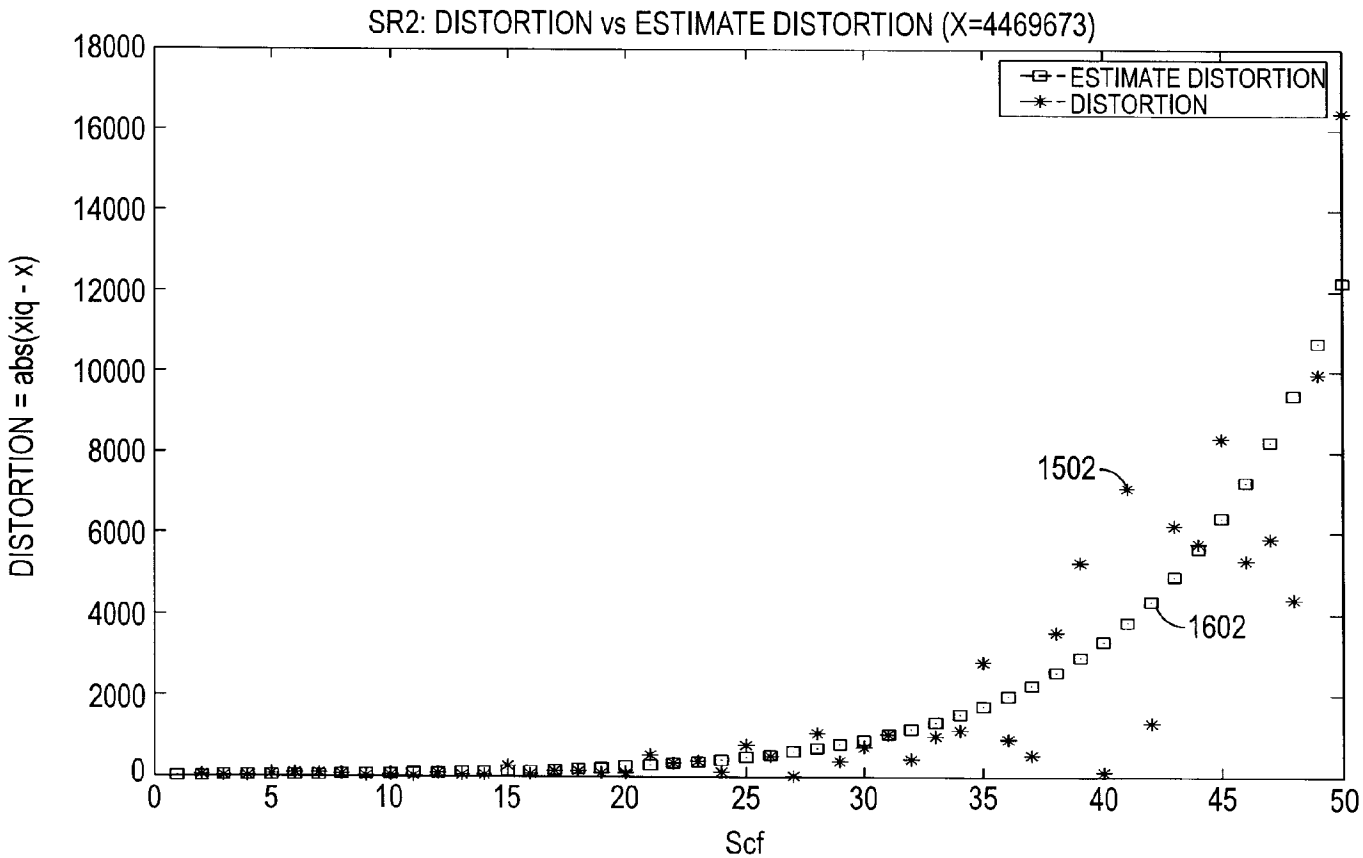
FIG. 16 is a plot of the calculated real distortion levels of FIG. 11, and a plot of estimated distortion levels determined using aspects of the described scalefactor estimation approach.

FIG. 16 is a plot of the real distortion levels 1502 shown in FIG. 15, and a plot of estimated distortion levels 1602 determined using aspects of the described scalefactor estimation approach.

Figure 17:
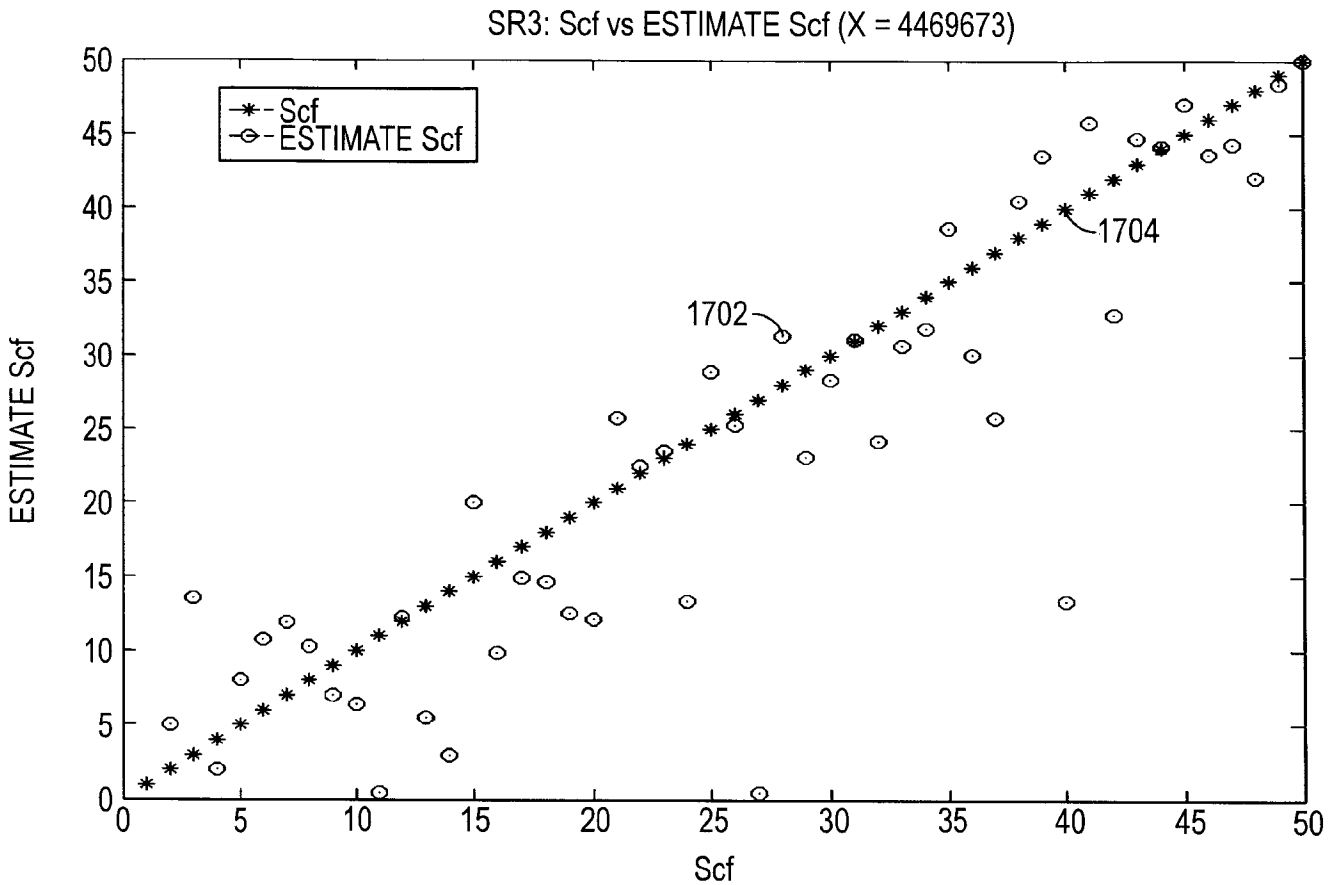
FIG. 17 is a plot of scalefactors estimated using aspects of the described scalefactor estimation approach based on real distortion levels calculated for audio spectrum values quantized using scalefactors selected from a set of linearly increasing scalefactors.

FIG. 17 is a plot of estimated scalefactors 1702 (represented on the y-axis), estimated using aspects of the described scalefactor estimation approach based on distortion levels calculated for audio spectrum values quantized using scalefactors (represented on the x-axis) selected from a set of linearly increasing scalefactors 1704. As demonstrated in FIG. 17, scalefactors can be effectively estimated from distortion levels, as described above with respect to equation [7] through equation [10].

Figure 18:
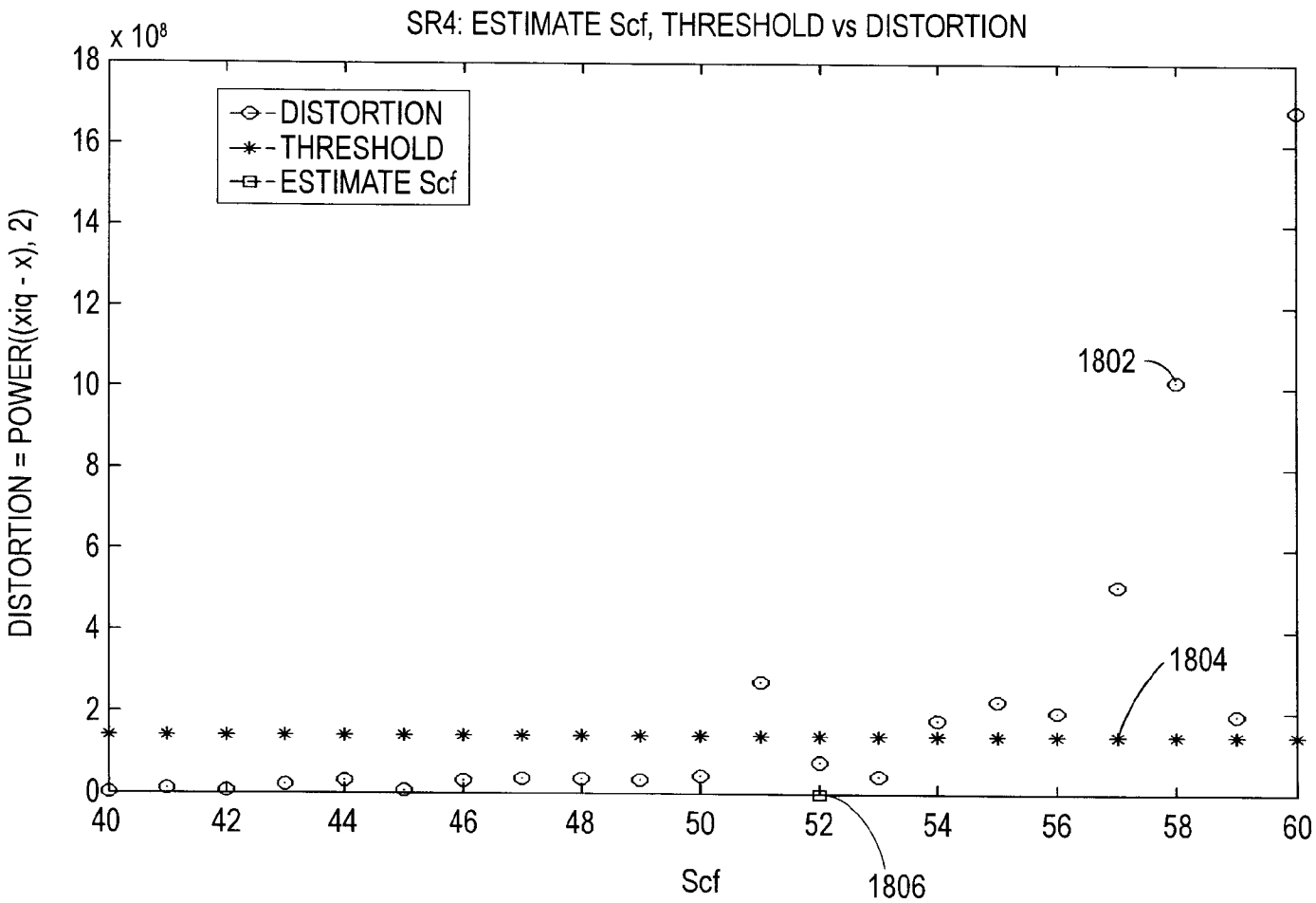
FIG. 18 includes a plot of calculated real distortion levels introduced to a stream of encoded audio spectrum values as a result of quantizing the audio spectrum values with a set of linearly increasing scalefactors, a plot of a maximum tolerant distortion threshold to be met by audio spectrum values quantized with an estimated scalefactor, and a plot of a scalefactor selected using the described scalefactor estimation approach.

FIG. 18 includes a plot of calculated real distortion levels 1802 introduced to a stream of encoded audio spectrum values as a result of quantizing the audio spectrum values with a set of linearly increasing scalefactors, a plot of a maximum tolerant distortion threshold 1804 to be met by audio spectrum values quantized with an estimated scalefactor, and a plot of an estimated scalefactor 1806 determined using the described scalefactor estimation approach. The maximum tolerant distortion threshold 1804 can be based on a psychoacoustic model, such as of human hearing, as explained at S810 of operation process 800 as shown in FIG. 8. As shown in FIG. 18, an estimated scalefactor, estimated using the described approach and shown in FIG. 18 as a single point at 1806, will introduce a level of distortion to quantized data that is below the maximum tolerant distortion threshold 1804.

It is noted that the AAC encoder quantization architecture, described above, can be used by a wide range of frequency-domain audio encoders, such as the advance audio coding (AAC) encoder.

It is noted that the modules described above with respect to AAC encoder quantization architecture embodiments, and the function that each module performs, may be implemented in any manner and may be integrated within and/or distributed across any number of modules in any manner. For example, such modules may be implemented in an AAC encoder quantization architecture using any combination of hardware, including application specific integrated circuits, microprocessors, systems on a chip, other specialized hardware, software and/or firmware and/or combination thereof.

For purposes of explanation in the above description, numerous specific details are set forth in order to provide a thorough understanding of the described embodiments of an AAC encoder quantization architecture. It will be apparent, however, to one skilled in the art based on the disclosure and teachings provided herein that the described embodiments may be practiced without these specific details. In other instances, well-known structures and devices are shown in block diagram form in order to avoid obscuring the features of the described embodiments.

While the embodiments of an AAC encoder quantization architecture have been described in conjunction with the specific embodiments thereof, it is evident that many alternatives, modifications, and variations will be apparent to those skilled in the art. Accordingly, the described embodiments, as set forth herein, are intended to be illustrative, not limiting. There are changes that may be made without departing from the spirit and scope of the invention.

What is claimed is:

1. An audio encoder comprising:

a base scalefactor estimation circuit, comprising:

a spectrum base scalefactor generating module configured to determine a base scalefactor for a scalefactor band (SFB) based on a spectrum value scalefactor generated for a spectrum value selected from the SFB; and a band scalefactor estimation module, comprising:

a delta scalefactor estimation module configured to determine a delta scalefactor based on a noise level and the base scalefactor; and a band scalefactor module configured to determine a band scalefactor for the SFB based on the determined base scalefactor and the determined delta scalefactor, wherein the noise level is determined based on a change in noise level across SFBs as a result of a change in the band scalefactor.

2. The audio encoder of claim 1, further comprising:

a maximum scalefactor module configured to determine a maximum scalefactor that will not quantize the SFB to zero; and a scalefactor clipping module configured to select a lesser of the maximum scalefactor and the band scalefactor for use in quantizing the SFB.

3. The audio encoder of claim 1, wherein the noise level is based, in part, on a global scalefactor adjustment applied to each SFB of a previously quantized frame and the base scalefactor.

4. The audio encoder of claim 1, further comprising:

a target bits per channel module configured to determine a target bit count for a frame channel based, in part, on a ratio of a perceptual entropy of the frame channel to a perceptual entropy of the frame.

5. The audio encoder of claim 1, wherein the noise level is determined based on the relationship $$deltaNoiseLevel = \frac{4}{3}\text{fraction} * 2^{\frac{3}{16}Scf_base} * \left(2^{\frac{3}{16}scf_delta} - 1\right)$$

wherein deltaNoiseLevel is the determined delta noise level,

Scf_base is the base scalefactor, fraction is a predetermined fraction, and

Scf_delta is the delta scalefactor and is set to one of a predetermined value and a global scalefactor adjustment applied to each SFB of a previously quantized frame.

6. The audio encoder of claim 1, wherein the band scalefactor module is configured to determine the band scalefactor based on the relationship $$Scf_band = Scf_base + Scf_delta$$

wherein Scf_band is the band scalefactor for the SFB,

Scf_base is the determined base scalefactor, and

Scf_delta is the determined delta scalefactor.

7. The audio encoder of claim 1, further comprising:

a quantization module configured to quantize a set of spectrum values within a channel frame based on a scalefactor generated for each SFB in the channel frame;

an encoding module configured to encode the quantized set of spectrum values; and a SFB adjustment module configured to increase a global scalefactor adjustment applied to each SFB scalefactor and repeat quantization and encoding of the channel frame if an encoded channel frame bit count is above a predetermined threshold.

8. The audio encoder of claim 1, further comprising:

a frequency domain transformation module configured to generate a set of spectrum values in the SFB based on a set of time-domain audio signal samples using a time-domain to frequency-domain transformation function; and a psychoacoustic module configured to generate a maximum tolerant distortion threshold for the SFB based on the set of spectrum values in the SFB.

9. The audio encoder of claim 8, further comprising:

a signal processing toolset configured to process the set of spectrum values in the SFB and the maximum tolerant distortion threshold received from the psychoacoustic module using at least one of:

a mid-side stereo coding process;

a temporal noise shaping process; and a perceptual noise substitution process.

10. The audio encoder of claim 1, wherein the scalefactor for the selected spectrum value is based on the relationship $$Scf1 = |X(k)| * \left(\frac{a}{\text{fraction}}\right)^{\frac{4}{3}}$$

wherein Scf1 is the scalefactor for the selected spectrum value, wherein X(k) is the selected spectrum value, wherein $$a = 3 * \left(\left(1 + 0.5 * \frac{Diff_k}{|X(k)|}\right)^{\frac{1}{2}} - 1\right),$$

wherein fraction is a predetermined fraction, and wherein $Diff_k$ is a distortion level at the selected spectrum value.

11. The audio encoder of claim 1, wherein the spectrum base scalefactor generating module generates the base scalefactor for the SFB based on the relationship $Scf=4*\log_2(Scf1)$, wherein Scf is a scalefactor for the SFB and Scf1 is the spectrum value scalefactor generated for the selected spectrum value.

12. A method of generating a band scalefactor for a scalefactor band (SFB), the method comprising:

determining a base scalefactor by a base scalefactor estimation circuit for the SFB based on a spectrum value scalefactor generated for a spectrum value selected from the SFB;

determining a noise level based on a change in noise level across SFBs as a result of a change in the band scalefactor;

determining a delta scalefactor based on the noise level and the base scalefactor; and determining the band scalefactor for the SFB based on the determined base scalefactor and the determined delta scalefactor.

13. The method of claim 12, further comprising:

determining a maximum scalefactor that will not quantize the SFB to a predetermined value; and selecting a lesser of the maximum scalefactor and the band scalefactor for use in quantizing the SFB.

14. The method of claim 12 wherein the noise level is based, in part, on a global scalefactor adjustment applied to each SFB of a previously quantized frame and the base scalefactor.

15. The method of claim 12, further comprising:

determining a target bit count for a frame channel based, in part, on a ratio of a perceptual entropy of the frame channel to a perceptual entropy of the frame.

16. The method of claim 12, wherein the noise level is determined based on the relationship $$deltaNoiseLevel = \frac{4}{3}\text{fraction} * 2^{\frac{3}{16}Scf_base} * \left(2^{\frac{3}{16}(Scf_delta)} - 1\right)$$

wherein deltaNoiseLevel is the determined delta noise level,

Scf_base is the base scalefactor, fraction is a predetermined fraction, and

Scf_delta is the delta scalefactor and is set to one of a predetermined value and a global scalefactor adjustment applied to each SFB of a previously quantized frame.

17. The method of claim 12, wherein the band scalefactor is determined based on the relationship Scf_band=Scf_base+Scf_delta wherein Scf_band is the band scalefactor for the SFB, Scf_base is the determined base scalefactor, and Scf_delta is the determined delta scalefactor.

18. The method of claim 12, further comprising:

quantizing a set of spectrum values within a channel frame based on a scalefactor generated for each SFB in the channel frame;

encoding the quantized set of spectrum values; and increasing a global scalefactor adjustment applied to each SFB scalefactor if an encoded channel frame bit count is above a predetermined threshold; and repeating quantization and encoding of the channel frame using the adjusted SFB scalefactors.

19. The method of claim 12, further comprising:

generating a set of spectrum values in the SFB based on a set of time-domain audio signal samples using a time-domain to frequency-domain transformation function; and generating a maximum tolerant distortion threshold for the SFB based on the set of spectrum values in the SFB.

20. The method of claim 19, further comprising:

processing the set of spectrum values in the SFB and the maximum tolerant distortion threshold using at least one of:

a mid-side stereo coding process;

a temporal noise shaping process; and a perceptual noise substitution process.

21. The method of claim 12, further comprising:

determining a distortion level for a spectrum value selected from a set of spectrum values in a SFB, based on a maximum tolerant distortion threshold for the SFB, and the set of spectrum values within the SFB; and determining the spectrum value scalefactor for the selected spectrum value based in part on the determined distortion level and the selected spectrum value.

22. An audio encoder executing the method of claim 12.

* * * * *